US010524318B2

(12) United States Patent
Hirano et al.

(10) Patent No.: US 10,524,318 B2
(45) Date of Patent: Dec. 31, 2019

(54) MICROWAVE OVEN

(71) Applicant: SHARP KABUSHIKI KAISHA, Osaka-shi, Osaka (JP)

(72) Inventors: Seiichi Hirano, Osaka (JP); Tatsuhiko Nakamura, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 674 days.

(21) Appl. No.: 15/106,666

(22) PCT Filed: Feb. 10, 2015

(86) PCT No.: PCT/JP2015/053601

§ 371 (c)(1),
(2) Date: Jun. 20, 2016

(87) PCT Pub. No.: WO2015/119287

PCT Pub. Date: Aug. 13, 2015

(65) Prior Publication Data

US 2017/0215237 A1 Jul. 27, 2017

(30) Foreign Application Priority Data

Feb. 10, 2014 (JP) ..... 2014-022988
Feb. 14, 2014 (JP) ..... 2014-026938

(51) Int. Cl.

| | |
|---|---|
| ***H05B 6/74*** | (2006.01) |
| ***H05B 6/66*** | (2006.01) |
| ***H05B 6/80*** | (2006.01) |
| *H05B 6/68* | (2006.01) |

(52) U.S. Cl.

CPC ..... *H05B 6/80* (2013.01); *H05B 6/666* (2013.01)

(58) Field of Classification Search

CPC ..... H05B 6/6464; H05B 6/666; H05B 6/68; H05B 6/681; H05B 6/6878; H05B 6/687; H05B 6/80

USPC ..... 219/715, 716, 718, 719, 721, 746, 747

See application file for complete search history.

(56) References Cited

U.S. PATENT DOCUMENTS

| | | | | |
|---|---|---|---|---|
| 5,395,453 | A | 3/1995 | Noda | |
| 5,548,103 | A | 8/1996 | Morita | |
| 5,565,655 | A * | 10/1996 | Jeon | G01G 7/06 219/708 |
| 2003/0110414 | A1 * | 6/2003 | Kim | H05B 6/68 714/34 |
| 2005/0087184 | A1 | 4/2005 | Yamauchi et al. | |
| 2008/0041358 | A1 | 2/2008 | Yamauchi et al. | |

(Continued)

FOREIGN PATENT DOCUMENTS

| | | | |
|---|---|---|---|
| JP | 61-165991 | A | 7/1986 |
| JP | 1 44969 | Y2 | 12/1989 |

(Continued)

*Primary Examiner* — Hung D Nguyen

(74) *Attorney, Agent, or Firm* — Birch, Stewart, Kolasch & Birch, LLP

(57) ABSTRACT

A microwave oven has a magnetron (11) which generates microwaves to heat a heating object, and a control unit (100) which controls the magnetron (11). During heating operation in which the heating object is heated with microwaves generated from the magnetron (11), the control unit (100) controls the magnetron (11) so as to suppress abnormal operations of the magnetron (11) in response to a status of power supply supplied from outside.

16 Claims, 20 Drawing Sheets

(56) References Cited

U.S. PATENT DOCUMENTS

| | | | | |
|---|---|---|---|---|
| 2012/0267948 | A1* | 10/2012 | Richards | H05B 6/66 307/9.1 |
| 2013/0087555 | A1 | 4/2013 | Hirano et al. | |

FOREIGN PATENT DOCUMENTS

| | | | | |
|---|---|---|---|---|
| JP | 2139891 | A | * | 5/1990 |
| JP | 2-217721 | A | | 8/1990 |
| JP | 8-26997 | B2 | | 3/1996 |
| JP | 9-17567 | A | * | 1/1997 |
| JP | 3026704 | B2 | | 3/2000 |
| JP | 2001-155848 | A | | 6/2001 |
| JP | 3184694 | B2 | | 7/2001 |
| JP | 2003-115374 | A | | 4/2003 |
| JP | 2004-95500 | A | | 3/2004 |
| JP | 2004-095500 | A | * | 3/2004 |
| JP | 2005-77063 | A | | 3/2005 |
| JP | 2009-228968 | A | | 10/2009 |
| JP | 2010-107110 | A | | 5/2010 |
| JP | 2013-167422 | A | * | 8/2013 |
| WO | WO 2012/005316 | A1 | | 1/2012 |

* cited by examiner

MICROWAVE OVEN

TECHNICAL FIELD

The present invention relates to microwave ovens.

BACKGROUND ART

Conventionally, there are microwave ovens in which food is heated in a heating chamber with microwaves derived from a magnetron (see, e.g., JP 2010-107110 A (PTL1)).

CITATION LIST

Patent Literature

PTL1: JP 2010-107110 A

SUMMARY OF INVENTION

Technical Problem

In cases where a microwave oven having the above-described structure is mounted on an airplane, microwaves from a magnetron are made to be periodically generated so as to prevent interference between the microwaves and an inboard wireless LAN (Local Area Network).

In such a microwave oven to be mounted on an airplane, its power frequency largely varies in response to flight conditions depending on the model of the airplane (e.g., Boeing 787 has AC power frequencies of 360 Hz to 800 Hz). For this reason, the microwave oven has a problem that when the frequency of its power supply voltage has deviated, during a heating operation with microwaves, from a normal operation range in which a microwave oven body can normally operate, oscillating operation of the magnetron is not performed normally.

More specifically, in this microwave oven, when the frequency of the power supply voltage lowers below a lower limit of the normal operation range during heating operation, the oscillation of the magnetron may come to an abnormal stop. When the frequency of the power supply voltage rises beyond an upper limit of the normal operation range, the magnetron may be superheated by the temperature rise and eventually damaged.

The above-described microwave oven to be mounted on airplanes also has a problem that when external power input comes to instantaneous power failure during heat cooking with microwaves, a preheating effect by the filament of the magnetron cannot be fulfilled upon recovery from the power failure, so that a moding (abnormal oscillation) state of the magnetron may result. The magnetron in such a moding state generates noise, which causes trouble in communications by the inboard wireless LAN and which may accelerate deterioration of the magnetron itself with its service life shortened.

Accordingly, an object of the invention is to provide a microwave oven capable of preventing abnormal operations of the magnetron even when the frequency of the power supply voltage has largely varied during heating operation with microwaves.

Another object of the invention is to provide a microwave oven capable of oscillating the magnetron reliably without incurring a moding state after recovery from instantaneous power failure during heating operation with microwaves.

Solution to Problem

A microwave oven according to an aspect of the invention comprises:

a magnetron which generates microwaves to heat a heating object (i.e., an object to be heated); and a control unit which controls the magnetron, wherein during heating operation in which the heating object is heated with microwaves generated from the magnetron, the control unit controls the magnetron so as to suppress abnormal operations of the magnetron in response to a status of power supply supplied from outside.

In one embodiment, the magnetron generates microwaves by power supply voltage supplied from outside, and the microwave oven further comprises:

a frequency detection part which detects a frequency of the power supply voltage; and a frequency discrimination part which discriminates whether or not the frequency of the power supply voltage detected by the frequency detection part is within a preset frequency range, wherein during heating operation in which the heating object is heated with microwaves generated from the magnetron, the control unit stops oscillation of the magnetron when the frequency discrimination part decides that the frequency of the power supply voltage is not within the preset frequency range.

In one embodiment, when the frequency discrimination part decides that the frequency of the power supply voltage has become within the frequency range after an oscillation stop of the magnetron during the heating operation, the control unit makes the magnetron oscillated to resume the heating operation.

In one embodiment, the microwave oven further comprises:

an oscillation-stop time measuring part which measures an oscillation stop time of the magnetron in the heating operation; and a heating time correcting part which, after an oscillation stop of the magnetron in the heating operation, corrects remaining heating time of the heating operation based on the oscillation stop time of the magnetron measured by the oscillation-stop time measuring part when the heating operation is resumed upon a decision by the frequency discrimination part that the frequency of the power supply voltage has become within the frequency range.

In one embodiment, the microwave oven further comprises a load capacity discrimination part which discriminates as to a load capacity of the microwaves, wherein the control unit sets a first oscillation mode in which microwaves are periodically generated from the magnetron when the load capacity discrimination part decides that the load capacity of the microwaves is equal to or lower than a preset load capacity discrimination criterion, and sets a second oscillation mode in which microwaves are continuously generated from the magnetron when the load capacity discrimination part decides that a load capacity of the microwaves detected by the load capacity discrimination part is larger than the load capacity discrimination criterion.

In one embodiment, the microwave oven further comprises:

a consumption time calculating part which calculates consumption time indicative of a degree of consumption due to oscillating operation of the magnetron for each heating operation based on a heating time for heating the heating object as well as on a duty ratio at which microwaves from the magnetron are periodically turned on and off;

a consumption time totalizing part which totalizes consumption times of the magnetron calculated by the consumption time calculating part;

a consumption time discrimination part which discriminates whether or not a total value of consumption times of the magnetron obtained by the consumption time totalizing part has exceeded a preset consumption time discrimination criterion; and a notification part which notifies a replacement timing of the magnetron when the consumption time discrimination part decides that the total value of the consumption times of the magnetron has exceeded the consumption time discrimination criterion.

In one embodiment, the microwave oven further comprises:

a magnetron driving part which applies high voltage to the magnetron; and a filament driving part which applies voltage to a filament of the magnetron, wherein the control unit controls the magnetron driving part and the filament driving part to generate microwaves from the magnetron, and when heating operation in which the heating object is heated with microwaves generated from the magnetron is resumed upon recovery from instantaneous power failure of power supply input supplied from outside, the control unit makes voltage application to the filament started by the filament driving part before making high voltage applied to the magnetron by the magnetron driving part.

In one embodiment, the microwave oven further comprises an instantaneous-power-failure time measuring part which measures instantaneous power failure time upon instantaneous power failure of the power supply input, wherein when heating operation in which the heating object is heated with microwaves periodically generated from the magnetron is resumed upon recovery from instantaneous power failure of the power supply input, and moreover when an instantaneous power failure time measured by the instantaneous-power-failure time measuring part is equal to or larger than a preset discrimination criterion, the control unit makes voltage application to the filament started by the filament driving part at a time point which is earlier than a time point at which high voltage is applied to the magnetron by the magnetron driving part.

In one embodiment, a post-recovery-from-instantaneous-power-failure preheating time, which is a time duration from a start of voltage application to the filament until high-voltage application to the magnetron, is determined based on an elapsed time from the start of voltage application to the filament or a temperature of the filament.

In one embodiment, the post-recovery-from-instantaneous-power-failure preheating time, which is a time duration from a start of voltage application to the filament until high-voltage application to the magnetron, is determined based on the instantaneous power failure time measured by the instantaneous-power-failure time measuring part.

In one embodiment, the microwave oven further comprises a magnetron oscillation detection part which detects oscillation of the magnetron with high voltage applied thereto by the magnetron driving part, wherein the control unit performs such control process that voltage is applied to the filament by the filament driving part over a range stretching before and after a rising point of a microwave generated from the magnetron, and that when the magnetron oscillation detection part has detected oscillation of the magnetron after the microwave rises, voltage application to the filament by the filament driving part is stopped.

In one embodiment, the microwave oven further comprises:

a cooling fan which cools the magnetron while the heating object is being heated with microwaves generated from the magnetron; and a power interrupting part which interrupts the power supply input supplied from outside, wherein the control unit drives the cooling fan during heating operation in which the heating object is heated with microwaves generated from the magnetron, where when the power supply input is interrupted by the power interrupting part after an end of the heating operation, voltage application to the filament by the filament driving part is stopped after elapse of a preset first stop time from a time point of the end of the heating operation at which the high-voltage application to the magnetron is stopped, and then, after elapse of a preset second stop time from a time point at which the voltage application to the filament is stopped, the cooling fan is stopped and the power supply input is interrupted by the power interrupting part.

A microwave oven according to another aspect of the invention comprises:

a magnetron which generates microwaves by power supply voltage supplied from outside;

a frequency detection part which detects a frequency of the power supply voltage;

a frequency discrimination part which discriminates whether or not the frequency of the power supply voltage detected by the frequency detection part is within a preset frequency range; and a control unit which controls the magnetron based on a result of the discrimination by the frequency discrimination part, wherein during heating operation in which the heating object is heated with microwaves generated from the magnetron, the control unit stops oscillation of the magnetron when the frequency discrimination part decides that the frequency of the power supply voltage is not within the preset frequency range.

In one embodiment, when the frequency discrimination part decides that the frequency of the power supply voltage has become within the frequency range after an oscillation stop of the magnetron during the heating operation, the control unit makes the magnetron oscillated, to resume the heating operation.

In one embodiment, the microwave oven further comprises:

an oscillation-stop time measuring part which measures an oscillation stop time of the magnetron in the heating operation; and a heating time correcting part which, after an oscillation stop of the magnetron in the heating operation, corrects remaining heating time of the heating operation based on the oscillation stop time of the magnetron measured by the oscillation-stop time measuring part when the heating operation is resumed upon a decision by the frequency discrimination part that the frequency of the power supply voltage has become within the frequency range.

In one embodiment, the microwave oven further comprises a load capacity discrimination part which discriminates as to a load capacity of the microwaves, wherein the control unit sets a first oscillation mode in which microwaves are periodically generated from the magnetron when the load capacity discrimination part decides that the load capacity of the microwaves is equal to or lower than a preset load capacity discrimination criterion, and sets a second oscillation mode in which microwaves are continuously generated from the magnetron when the load capacity discrimination part decides that a load capacity of the microwaves detected by the load capacity discrimination part is larger than the load capacity discrimination criterion.

In one embodiment, the microwave oven further comprises:

a consumption time calculating part which calculates consumption time indicative of a degree of consumption due to oscillating operation of the magnetron for each heating operation based on a heating time for heating the heating object as well as on a duty ratio at which microwaves from the magnetron are periodically turned on and off;

a consumption time totalizing part which totalizes consumption times of the magnetron calculated by the consumption time calculating part;

a consumption time discrimination part which discriminates whether or not a total value of consumption times of the magnetron obtained by the consumption time totalizing part has exceeded a preset consumption time discrimination criterion; and a notification part which notifies a replacement timing of the magnetron when the consumption time discrimination part decides that the total value of the consumption times of the magnetron has exceeded the consumption time discrimination criterion.

A microwave oven according to another aspect of the invention comprises:

a magnetron which generates microwaves to heat a heating object;

a magnetron driving part which applies high voltage to the magnetron;

a filament driving part which applies voltage to a filament of the magnetron; and a control unit which controls the magnetron driving part and the filament driving part to generate microwaves from the magnetron, wherein when heating operation in which the heating object is heated with microwaves generated from the magnetron is resumed upon recovery from instantaneous power failure of power supply input supplied from outside the control unit makes voltage application to the filament started by the filament driving part before making high voltage applied to the magnetron by the magnetron driving part.

In one embodiment, the microwave oven further comprises an instantaneous-power-failure time measuring part which measures instantaneous power failure time upon instantaneous power failure of the power supply input, wherein when heating operation in which the heating object is heated with microwaves periodically generated from the magnetron is resumed upon recovery from instantaneous power failure of the power supply input, and moreover when an instantaneous power failure time measured by the instantaneous-power-failure time measuring part is equal to or larger than a preset discrimination criterion, the control unit makes voltage application to the filament started by the filament driving part at a time point which is earlier by the post-recovery-from-instantaneous-power-failure preheating time than a time point at which high voltage is applied to the magnetron by the magnetron driving part.

In one embodiment, a post-recovery-from-instantaneous-power-failure preheating time, which is a time duration from a start of voltage application to the filament until high-voltage application to the magnetron, is determined based on an elapsed time from the start of voltage application to the filament or a temperature of the filament.

In one embodiment, post-recovery-from-instantaneous-power-failure preheating time, which is a time duration from a start of voltage application to the filament until high-voltage application to the magnetron, is determined based on the instantaneous power failure time measured by the instantaneous-power-failure time measuring part.

In one embodiment, the microwave oven further comprises a magnetron oscillation detection part which detects oscillation of the magnetron with high voltage applied thereto by the magnetron driving part, wherein the control unit performs such control process that voltage is applied to the filament by the filament driving part over a range stretching before and after a rising point of a microwave generated from the magnetron, and that when the magnetron oscillation detection part has detected oscillation of the magnetron after the microwave rises, voltage application to the filament by the filament driving part is stopped.

In one embodiment, the microwave oven further comprises:

a cooling fan which cools the magnetron while the heating object is being heated with microwaves generated from the magnetron; and a power interrupting part which interrupts the power supply input supplied from outside, wherein the control unit drives the cooling fan during heating operation in which the heating object is heated with microwaves generated from the magnetron, where when the power supply input is to be interrupted by the power interrupting part after an end of the heating operation, voltage application to the filament by the filament driving part is stopped after elapse of a preset first stop time from a time point of the end of the heating operation at which the high-voltage application to the magnetron is stopped, and then, after elapse of a preset second stop time from a time point at which the voltage application to the filament is stopped, the cooling fan is stopped and the power supply input is interrupted by the power interrupting part.

Advantageous Effects of Invention

As is apparent from above, according to the present invention, when the frequency of the power supply voltage is not within the preset frequency range during heating operation in which a heating object heated with microwaves generated from the magnetron, the oscillation of the magnetron is stopped. Thus, a microwave oven is achieved in which even if the frequency of the power supply voltage has largely varied during the heating operation with microwaves, abnormal operation of the magnetron can be prevented.

Furthermore, according to the present invention, according to this embodiment, when heating operation is resumed upon recovery from instantaneous power failure of power supply input during heating operation in which the heating object is heated with microwaves, preheating is started by applying voltage to the filament at a time point earlier by a preset preheating time than a time point at which high voltage is applied to the magnetron. Thus, a microwave oven is achieved in which after recovery from instantaneous power failure of power supply input, the magnetron is oscillated reliably without incurring its moding state.

DESCRIPTION OF EMBODIMENTS

Hereinbelow, the microwave oven of the present invention will be described in detail by embodiments thereof illustrated in the accompanying drawings.

First Embodiment

Figure 1:
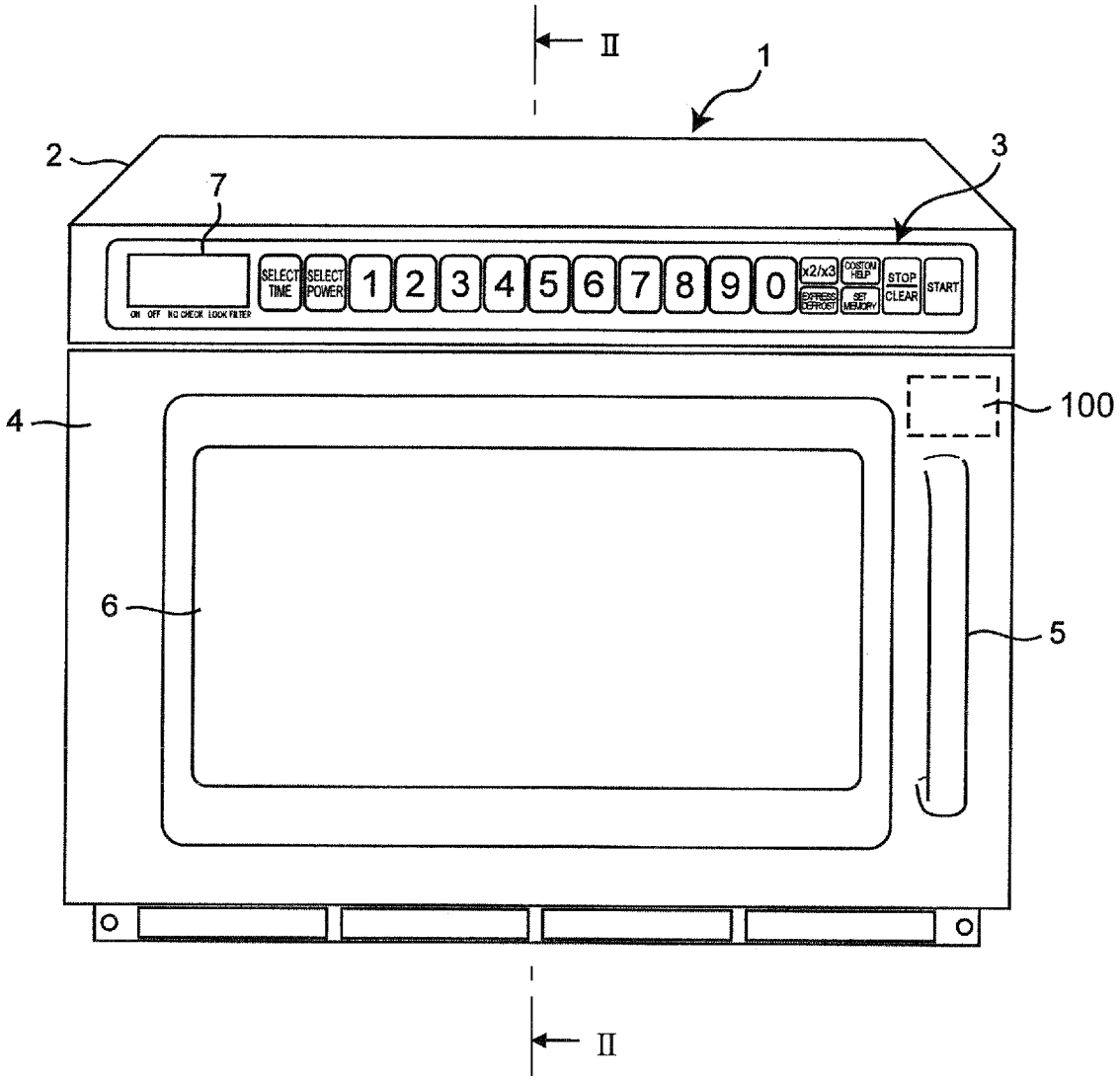
FIG. 1 is a front view of a microwave oven according to a first embodiment of the invention.

FIG. 1 is a front view of a microwave oven 1 according to a first embodiment of the invention. The microwave oven 1 of the first embodiment is intended to be mounted on an airplane equipped with a wireless LAN (Local Area Network).

In the microwave oven 1 of the first embodiment, as shown in FIG. 1, an operation section 3 is provided in a front upper part of a rectangular parallelepiped-shaped cabinet 2. A door 4 which is pivotable around a left end side to open and close a heating chamber 10 (shown in FIG. 2) is provided in the frontage of the cabinet 2 below the operation section 3. A handle 5 is provided at a right portion of the door 4, and a window 6 made from heat-resistant glass is fitted into the door 4. Further, an LCD (Liquid Crystal Display) part 7 is provided on the left side in the operation section 3 as viewed in the figure. Operating a key in the operation section 3 causes a content corresponding to the key operation to be displayed on the LCD part 7 by a control unit 100.

Figure 2:
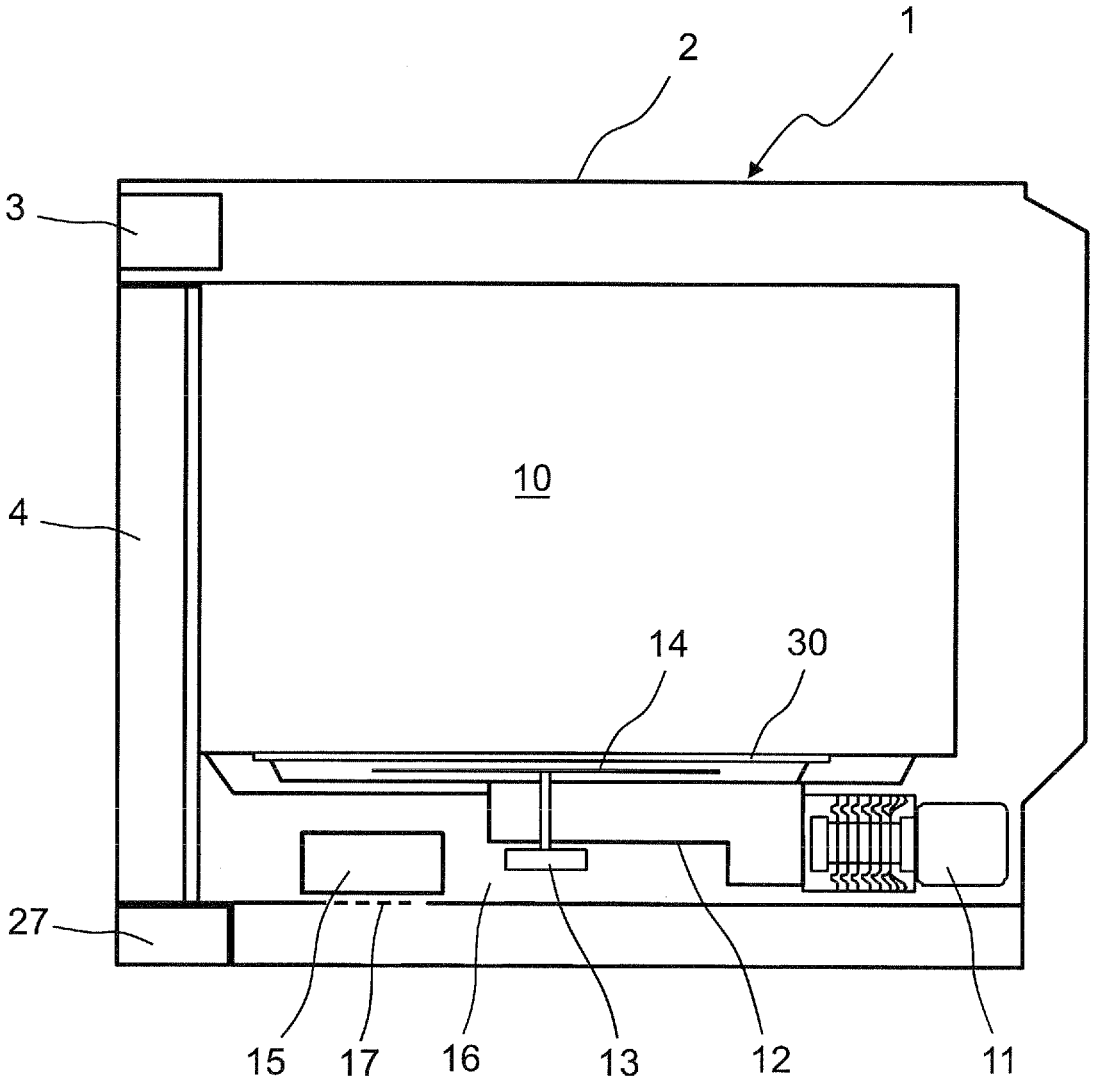
FIG. 2 is a sectional view taken along the line II-II of FIG. 1.

The microwave oven 1 is to heat a heating object (i.e., an object to be heated) placed in the heating chamber 10 by means of microwaves generated by a magnetron 11 (shown in FIG. 2). The structure for heating the heating object with microwaves is similar to that of conventional microwave ovens using microwaves.

FIG. 2 is a sectional view taken along the line of FIG. 1. In FIG. 2, like component members in conjunction with FIG. 1 are designated by like reference signs. Reference sign 27 in FIG. 2 denotes a refuse receiver.

As shown in FIG. 2, the heating chamber 10 is placed in the cabinet 2, and the magnetron 11 is placed at a rear face-side lower portion below the heating chamber 10 within the cabinet 2. Microwaves generated by the magnetron 11 are led by a waveguide 12 to a center of the lower portion below the heating chamber 10, and then radiated upward within the heating chamber 10 while being rotated by a rotating antenna 14 driven by a rotating-antenna motor 13. Thus, the heating object on a bottom tray 30 is heated.

Provided below the heating chamber 10 in the cabinet 2 is an outside-air inflow duct 16 in which a cooling fan 15, the waveguide 12 and the magnetron 11 are disposed. At a position facing the cooling fan 15 on a lower surface of the outside-air inflow duct 16, an outside-air inflow port 17 is provided so that outside air is brought into the outside-air inflow duct 16 through the outside-air inflow port 17 by the operation of the cooling fan 15.

Figure 3:
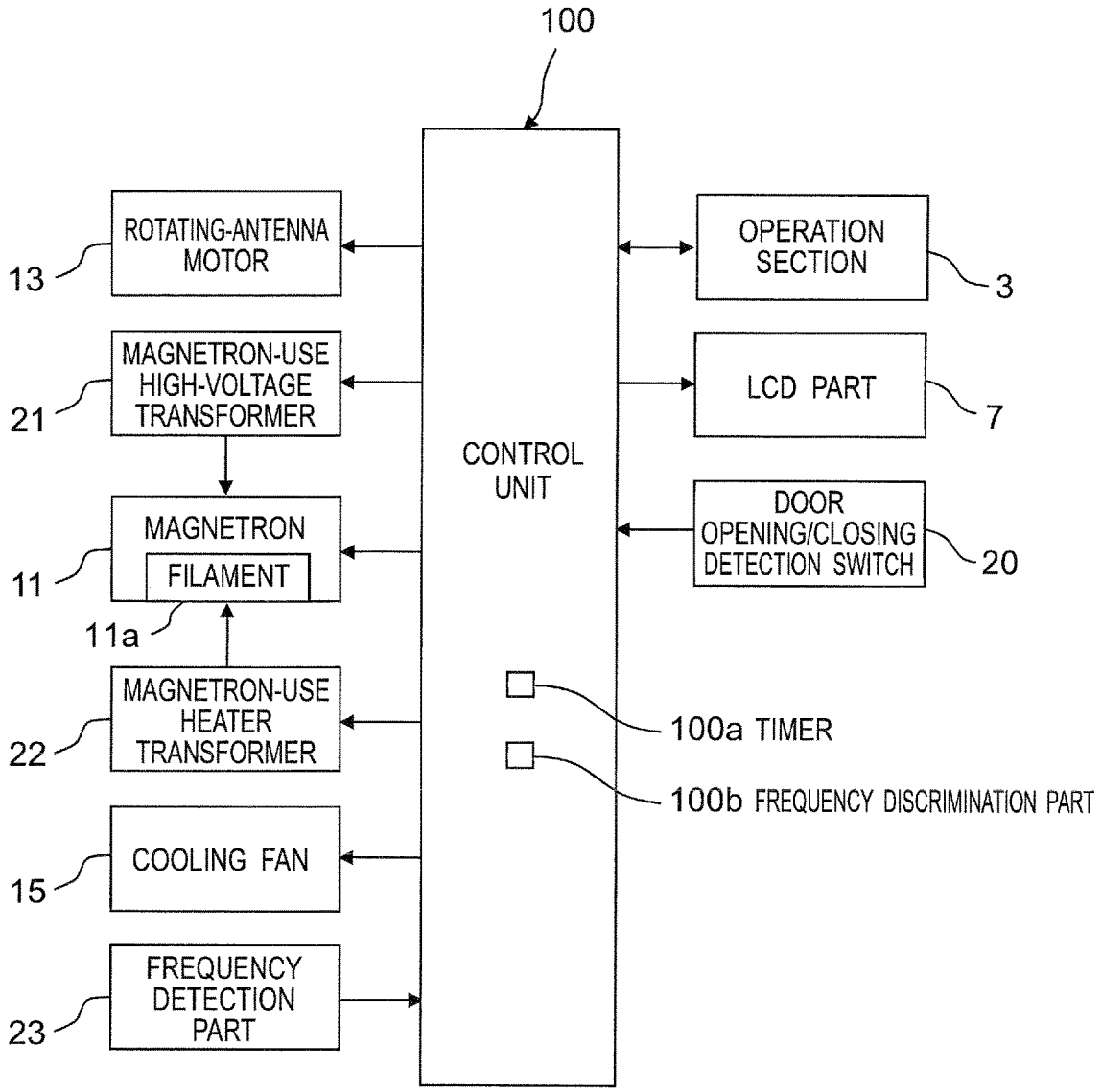
FIG. 3 is a block diagram showing an outlined configuration of a control unit of the microwave oven.

FIG. 3 shows an outlined configuration of the control unit 100 of the microwave oven 1 (shown in FIG. 1). The control unit 100, which is composed of a microcomputer, input/output circuits and the like, includes a timer 100*a* for counting heating time or the like and a frequency discrimination part 100*b* which discriminates as to a frequency of the power supply voltage detected by a frequency detection part 23.

The frequency detection part 23 is composed of a conversion circuit (not shown) for converting an AC voltage signal of the power supply voltage supplied from the external into zero-cross pulses, and a counter (not shown) for counting the zero-cross pulses.

Not being limited to the above one, the frequency detection part may be one which estimates the frequency of the power supply voltage based on a primary-side input current or a secondary-side output current of a magnetron-use high-voltage transformer 21 that applies a high voltage to the magnetron 11. In more detail, since there is a correlation between the primary-side input current (or secondary-side output current) of the magnetron-use high-voltage transformer 21 and the frequency of the power supply voltage, preliminarily determining characteristics of the correlation by experiments or the like and utilizing those characteristics makes it possible to estimate the frequency of the power supply voltage.

Based on signals from the operation section 3, a door opening/closing detection switch 20, the frequency detection part 23 and the like, the control unit 100 controls the LCD part 7, the rotating-antenna motor 13, the magnetron-use high-voltage transformer 21 which applies a high voltage to the magnetron 11, a magnetron-use heater transformer 22 which applies a voltage to a filament 11*a* of the magnetron 11, the cooling fan 15, a power interrupting part (not shown), and the like.

The magnetron-use high-voltage transformer 21 and a first switch part (not shown) for turning on and off the AC voltage applied to the input side of the magnetron-use high-voltage transformer 21 constitute a magnetron driving part. The magnetron-use heater transformer 22 and a second switch part (not shown) for turning on and off the AC voltage applied to the input side of the magnetron-use heater transformer 22 constitute a filament driving part.

Figure 4:
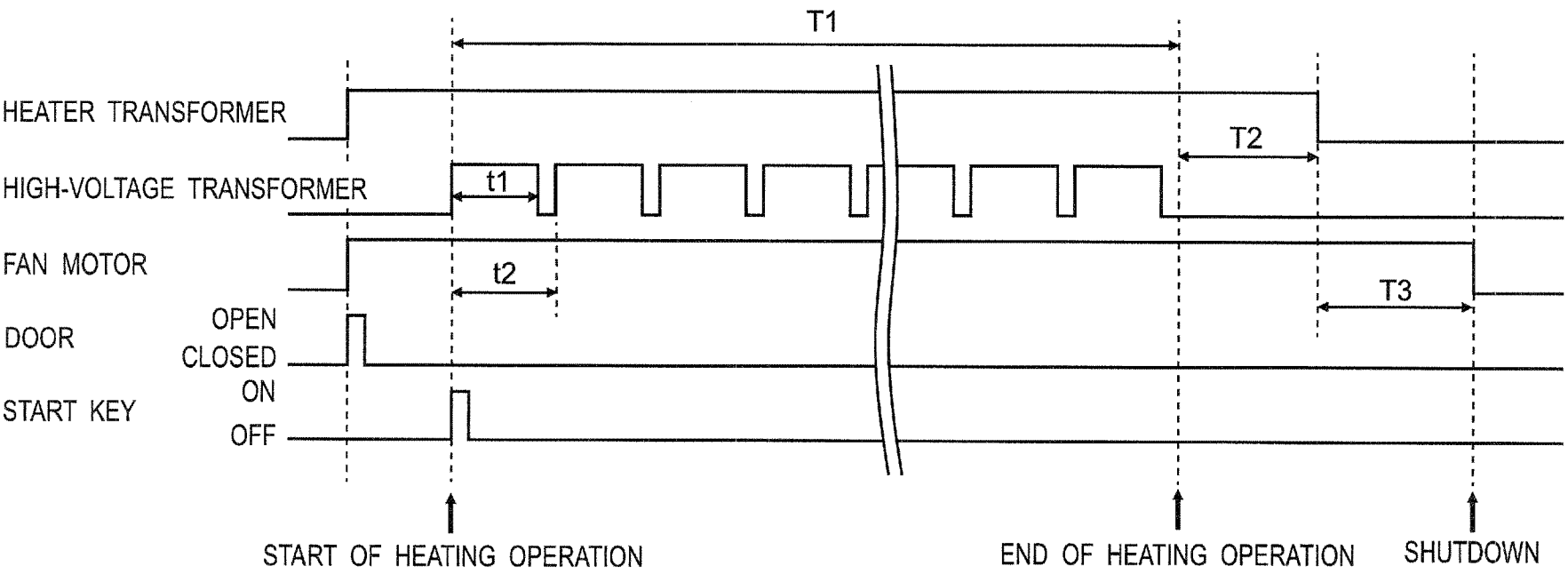
FIG. 4 is a timing chart of heating operation with microwaves in the microwave oven.

FIG. 4 is a timing chart of heating operation with microwaves in the microwave oven 1 in FIG. 4, times t1, t2, T1, T2 and T3 are made different from actual times for the sake of an easier viewing of the drawing.

First, when the user opens or closes the door 4 to set a heating object in the heating chamber 10, opening/closing of the door 4 is detected by the door opening/closing detection switch 20. Upon reception of a signal indicative of the door 4 having been opened from the door opening/closing detection switch 20, the control unit 100 starts voltage application to the filament 11*a* via the magnetron-use heater transformer 22. At this time point, the control unit 100 drives the cooling fan 15 (drives a fan motor shown in FIG. 4).

Next, heating operation is started by turning on the start key of the operation section 3, so that a heating object is heated with microwaves periodically generated from the magnetron 11. In this case, the magnetron 11 repeats oscillation (t1=2.5 sec.) and stop (0.5 sec.) of microwaves. The period t2 of microwave oscillation in this case is 3.0 sec., and its duty ratio is t1/t2 (=2.5 sec./3.0 sec.). This periodical microwave oscillation makes it possible to prevent communication failures of the wireless LAN in the airplane.

Upon completion of the heating time T1, first, the oscillation of the magnetron 11 is stopped, and then, after a first stop time T2 has passed, the voltage application to the magnetron-use heater transformer 22 is stopped. After elapse of a second stop time T3 from the stop of the voltage application to the filament 11*a*, the cooling fan 15 is stopped and moreover application of the power supply voltage is interrupted (shutdown) by the power interrupting part (not shown).

Figure 5:
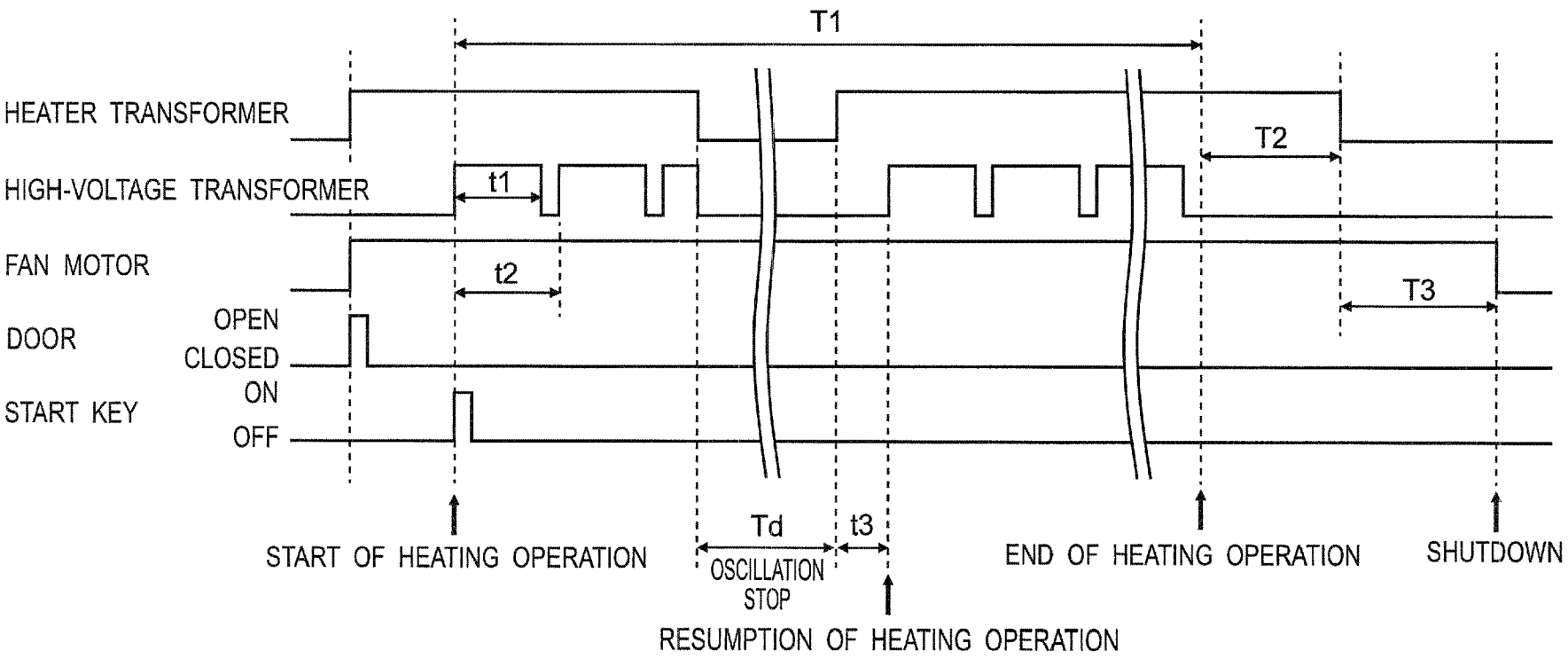
FIG. 5 is a timing chart for process upon an operation stop of the magnetron due to frequency variation of the power supply voltage during heating operation of the microwave oven.

FIG. 5 is a timing chart for process upon an oscillation stop of the magnetron 11 due to frequency variation of the power supply voltage during heating operation of the microwave oven 1. Operations or actions in FIG. 5 except during the oscillation stop of the magnetron 11 are same as those during the heating operation shown in FIG. 4. In FIG. 5, times t1, t2, t3, T1, T2, T3 and Td are different from actual times for the sake of easier viewing of the drawing.

It is assumed here that the frequency of the power supply voltage of the airplane on which the microwave oven 1 is to be mounted varies within a range of from 360 Hz to 800 Hz, inclusive.

As shown in FIG. 5, during heating operation in which the heating object is heated with microwaves periodically generated from the magnetron 11, a frequency of the power supply voltage is detected by the frequency detection part 23. If it is decided by the frequency discrimination part 100*b* that the frequency of the power supply voltage is not within a specified frequency range (680 Hz±10%), then the control unit 100 stops the voltage application to the magnetron-use high-voltage transformer and the magnetron-use heater transformer 22, by which the oscillation of the magnetron 11 is stopped.

Next, if it is decided by the frequency discrimination part 100*b* that a frequency of the power supply voltage detected by the frequency detection part 23 after the oscillation stop of the magnetron 11 is again within the specified frequency range (680 Hz±10%), the control unit 100 applies the voltage to the filament 11*a* via the magnetron-use heater transformer 22 to start preheating and, a specified preheating time t3 later, applies a high voltage to the magnetron 11 via the magnetron-use high-voltage transformer 21.

As a result of this, if the frequency of the power supply voltage has largely varied in heating operation with microwaves, the oscillation of the magnetron can be stopped so that abnormal operations can be prevented. After the oscillation stop of the magnetron 11, if it is decided by the frequency discrimination part 100*b* that the frequency of the power supply voltage is within the specified frequency range (680 Hz±10%), it becomes possible to normally oscillate the magnetron 11 once again.

Preheating the filament 11*a* before applying high voltage to the magnetron 11 for its oscillation allows the magnetron 11, which was in the oscillation-stopped state, to be oscillated reliably without incurring the moding state of the magnetron 11 after the frequency of the power supply voltage falls within the specified frequency range.

According to the above-described microwave oven 1, after the oscillation stop of the magnetron 11 in heating operation, if it is decided by the frequency discrimination part 100*b* that the frequency of the power supply voltage is within the specified frequency range (680 Hz±10%), the control unit 100 makes the magnetron 11 oscillated to resume the heating operation. Thus, even though the frequency of the power supply voltage has largely varied to cause a stop of the magnetron 11, heat cooking process can be finished completely.

Second Embodiment

Figure 6:
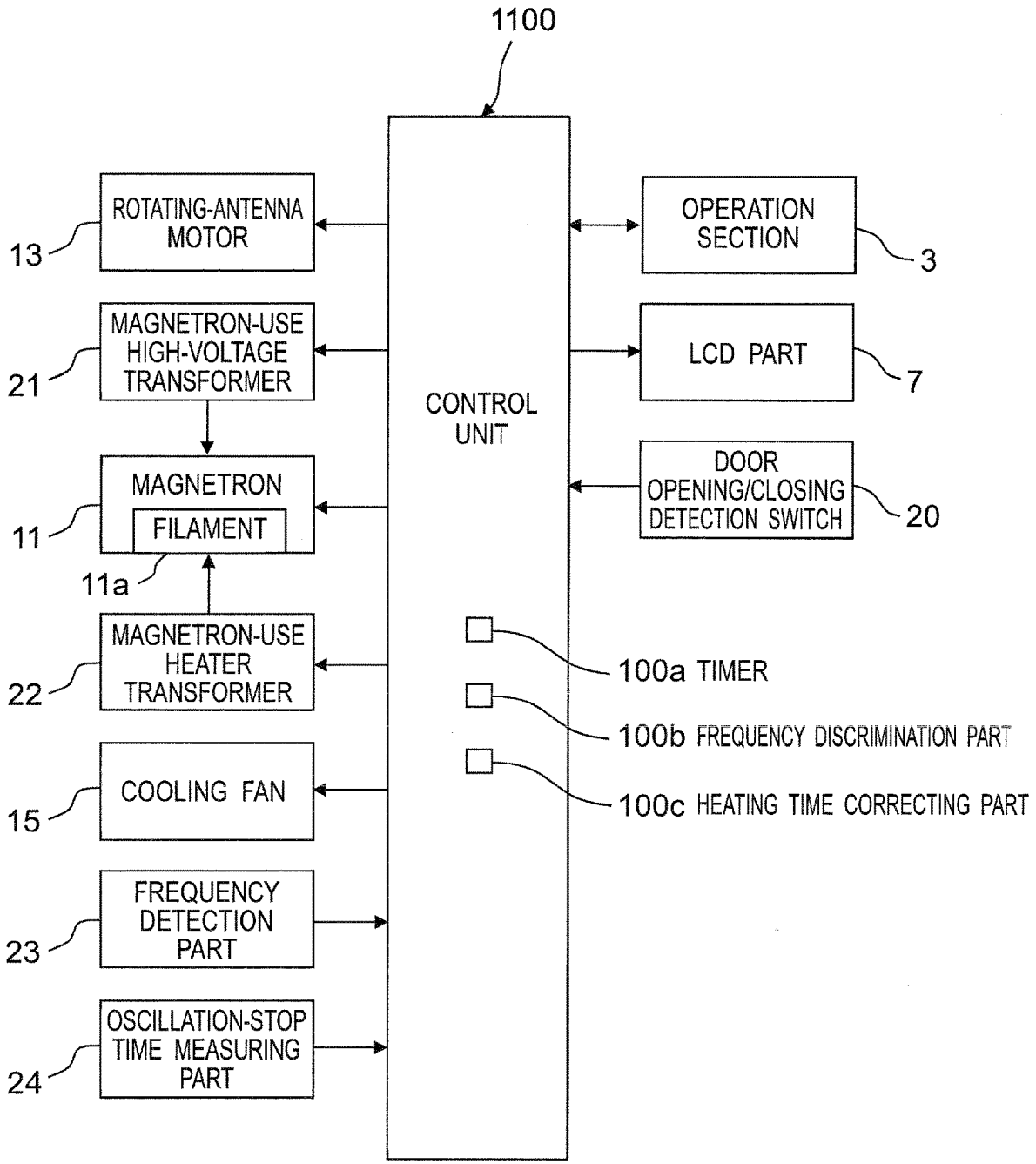
FIG. 6 is a block diagram showing an outlined configuration of a control unit of a microwave oven according to a second embodiment of the invention.

FIG. 6 shows an outlined configuration of a control unit 1100 of a microwave oven according to a second embodiment of the invention. Except for an oscillation-stop time measuring part 24 and a control unit 1100, the microwave oven of this second embodiment is similar in configuration to the microwave oven of the first embodiment, and so FIGS. 1 and 2 are used also for this embodiment.

The control unit 1100, which is composed of a microcomputer, input/output circuits and the like, includes a timer 100*a* for counting heating time or the like, a frequency discrimination part 100*b* which discriminates as to a frequency of the power supply voltage detected by the frequency detection part 23, and a heating time correcting part 100*c* for correcting remaining heating time based on an oscillation stop time Td measured by an oscillation-stop time measuring part 24.

The oscillation-stop time measuring part 24 measures the oscillation stop time Td resulting when the oscillation of the magnetron 11 is stopped due to a deviation of the frequency of the power supply voltage from a specified frequency range (680 Hz±10%) during heating operation. For this oscillation-stop time measuring part, the timer 100*a* of the control unit 1100 may be used or a timer provided separately in the control unit may be used.

Based on signals from the operation section 3, the door opening/closing detection switch 20, the frequency detection part 23, the oscillation-stop time measuring part 24 and the like, the control unit 100 controls the LCD part 7, the rotating-antenna motor 13, the magnetron-use high-voltage transformer 21 which applies high voltage to the magnetron 11, the magnetron-use heater transformer 22 which applies voltage to the filament 11*a* of the magnetron 11, the cooling fan 15, the power interrupting part (not shown), and the like.

According to the microwave oven of the second embodiment, after an oscillation stop of the magnetron 11 during heating operation, when the heating operation is resumed upon a decision by the frequency discrimination part 100*b* that a frequency of the power supply voltage is within the frequency range (680 Hz±10%), the remaining heating time of the heating operation is corrected by the heating time correcting part 100*c* based on an oscillation stop time Td of the magnetron 11 measured by the oscillation-stop time measuring part 24. In this process, the longer the oscillation stop time is, the further the heating object is cooled, so that the heating time correcting part 100*c* sets the remaining heating time longer. The correction of the heating time by the heating time correcting part 100*c* may be executed based on not only the oscillation stop time but also both a load capacity of microwaves or other condition and the oscillation stop time.

As a result of this, even if the oscillation of microwaves has stopped during heating operation due to frequency variation of the power supply voltage, the rest of the heating process can be fulfilled with a heating time corrected in response to the oscillation stop time Td. Thus, the heating operation can be completed without deteriorating the heating quality.

Determining the preheating time t3 based on the oscillation stop time Td measured by the oscillation-stop time measuring part 24 allows an optimum preheating time to be set in correspondence to a degree of temperature decrease of the filament 11*a*. As a result, the temperature of the filament 11*a* for making the magnetron 11 oscillated again after the oscillation was stopped can be optimized.

The microwave oven of the second embodiment has same effects as the microwave oven of the first embodiment.

Third Embodiment

Figure 7:
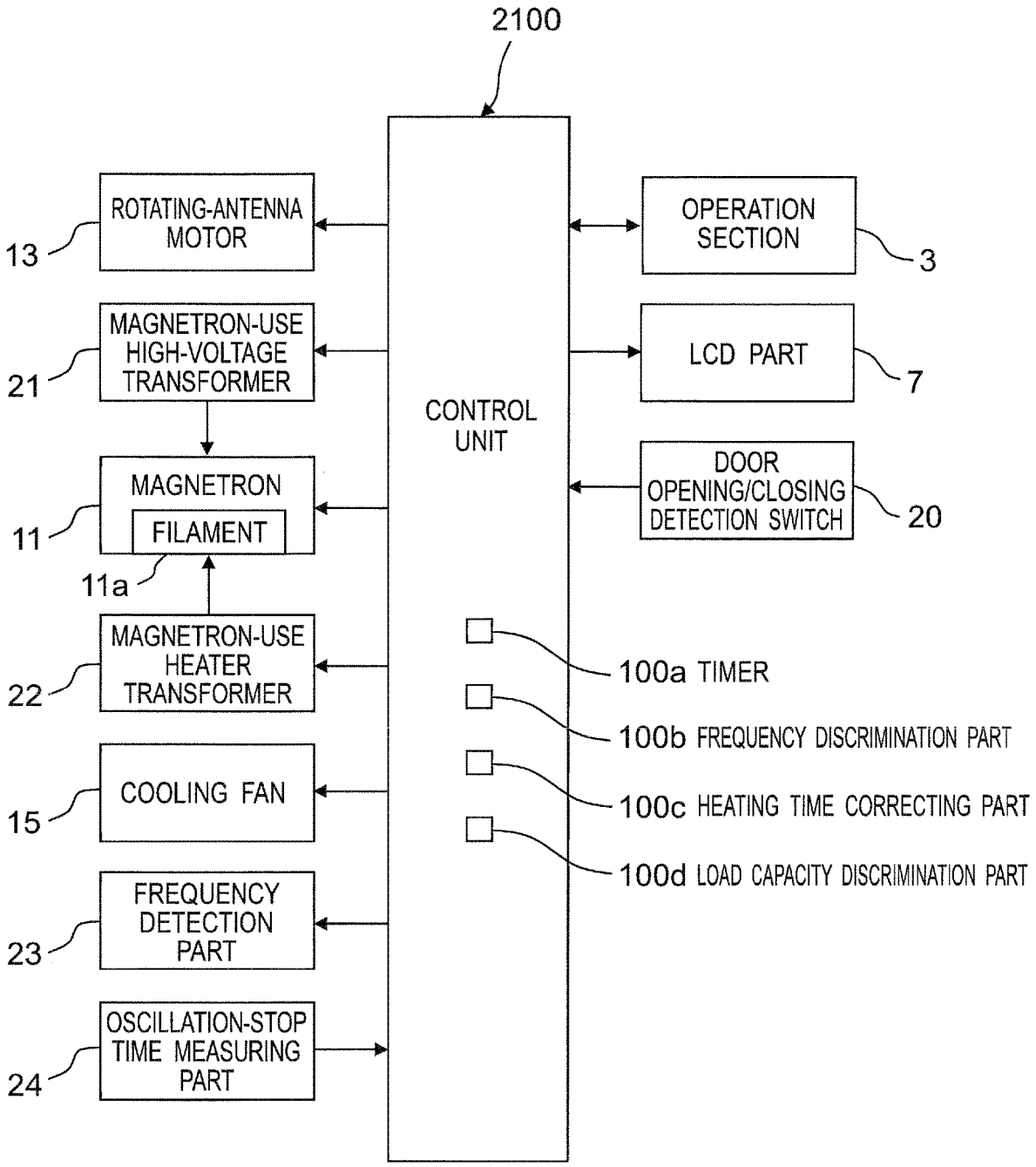
FIG. 7 is a block diagram showing an outlined configuration of a control unit of a microwave oven according to a third embodiment of the invention.

FIG. 7 shows an outlined configuration of a control unit 2100 of a microwave oven according to a third embodiment of the invention. Except for a control unit 2100, the microwave oven of this third embodiment is similar in configuration to the microwave oven of the second embodiment, and so FIGS. 1 and 2 are used also for this embodiment.

The control unit 2100, which is composed of a microcomputer, input/output circuits and the like, includes a timer 100*a* for counting heating time or the like, a frequency discrimination part 100*b* which discriminates as to a frequency of the power supply voltage detected by the frequency detection part 23, a heating time correcting part 100*c* for correcting remaining heating time based on an oscillation stop time Td measured by the oscillation-stop time measuring part 24, and a load capacity discrimination part 100*d* which discriminates as to a load capacity of microwaves.

The load capacity discrimination part 100*d* decides whether a load capacity of microwaves set by the user's operation of the operation section 3 is lower than a specified load capacity discrimination criterion or not.

The load capacity of microwaves is not limited to those inputted by the user, and may be given by estimating the load capacity of microwaves from the size of a container including the heating object or the weight of the heating object, for example, with use of a load capacity detection part for optically or mechanically detecting a size of the heating object (or a container including the heating object) or use of a load capacity detection part which detects a weight of the heating object by a weight sensor provided near the bottom tray.

In the microwave oven of the above configuration, when the load capacity discrimination part 100*d* has decided upon a start of heat cooking that the load capacity of microwaves is not more than the specified load capacity discrimination criterion, the control unit 2100 sets a first oscillation mode in which microwaves are periodically generated from the magnetron 11. As a result, when the microwave oven is mounted on an airplane, interference between microwaves and the inboard wireless LAN (Local Area Network) can be prevented.

With the above microwave oven, as the load capacity of microwaves becomes larger and larger, an unnecessary radiation quantity of microwaves leaking outside from within the cabinet 2 decreases more and more. Therefore, when it is decided that a load capacity of microwaves detected by the load capacity discrimination part 100*d* upon a start of heat cooking is larger than the load capacity discrimination criterion, the control unit 2100 sets a second oscillation mode in which microwaves are continuously generated from the magnetron 11. As a result of this, even a heating object of high load capacity that involves high power can be heated without affecting the inboard wireless LAN. Thus, in the heating operation for rice cooking or other heating operation that requires high-power microwaves, microwaves can be continuously oscillated so as to fulfill heating with maximum power, so that the cooking time can be shortened and moreover the finished cooking quality can be improved.

The microwave oven of the third embodiment has same effects as the microwave oven of the second embodiment.

Fourth Embodiment

Figure 8:
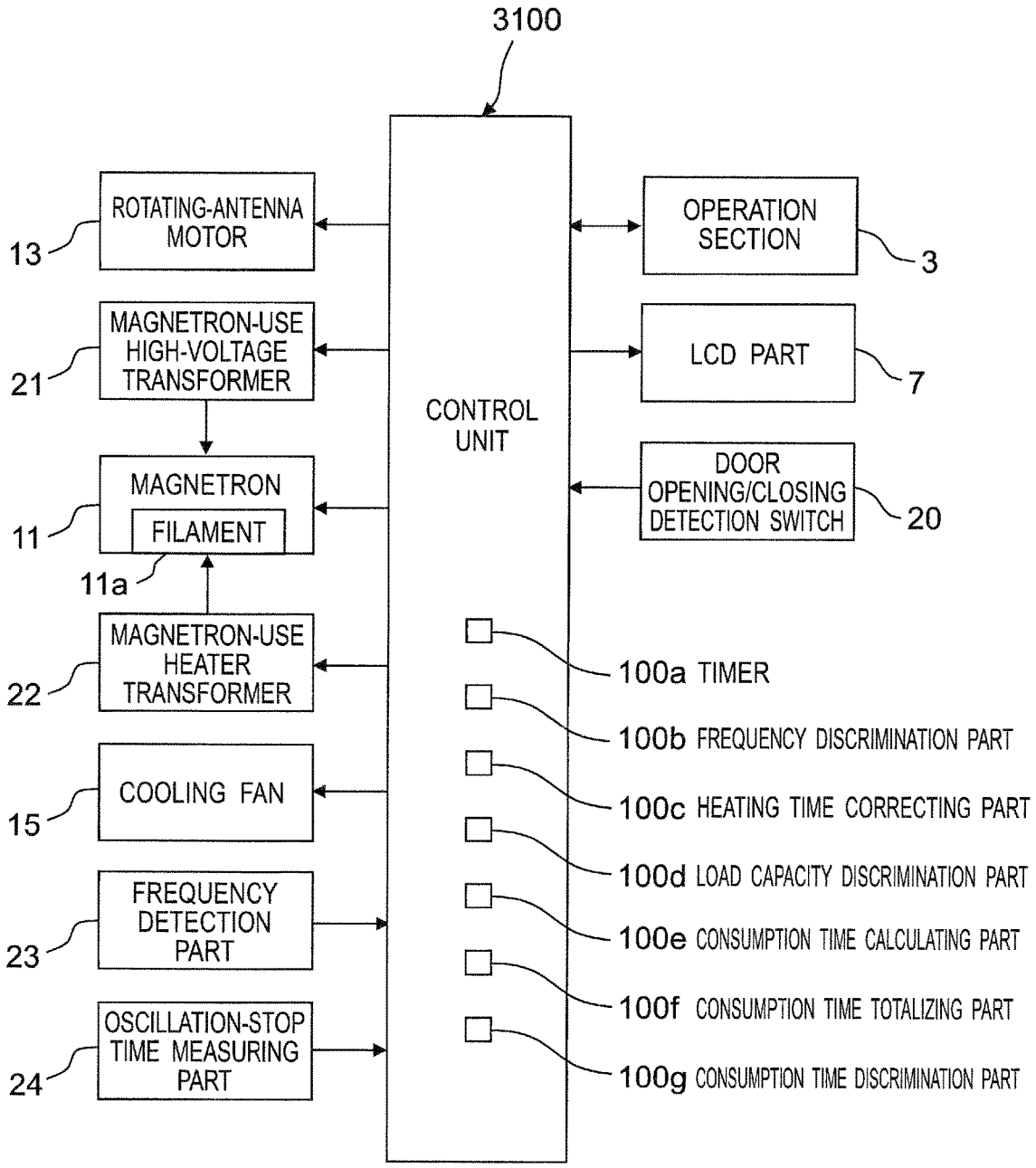
FIG. 8 is a block diagram showing an outlined configuration of a control unit of a microwave oven according to a fourth embodiment of the invention.

FIG. 8 shows an outlined configuration of a control unit 3100 of a microwave oven according to a fourth embodiment of the invention. Except for the control unit 3100, the microwave oven of this fourth embodiment is similar in configuration to the microwave oven of the third embodiment, and so FIGS. 1 and 2 are used also far this embodiment.

The control unit 3100, which is composed of a microcomputer, input/output circuits and the like, includes a timer 100*a* for counting heating time or the like, a frequency discrimination part 100*b* which discriminates as to a frequency of the power supply voltage detected by the frequency detection part 23, a heating time correcting part 100*c* for correcting remaining heating time based on an oscillation stop time Td measured by the oscillation-stop time measuring part 24, a load capacity discrimination part 100*d* which discriminates as to a load capacity of microwaves, a consumption time calculating part 100*e* which calculates consumption time indicative of a degree of consumption of the magnetron due to its oscillating operation, a consumption time totalizing part 100*f* which totalizes consumption times of the magnetron 11 calculated by the consumption time calculating part 100*e*, and a consumption time discrimination part 100*g* which discriminates as to a total value of the consumption times of the magnetron 11 obtained by the consumption time totalizing part 100*f*.

The consumption time calculating part 100*e* calculates a consumption time representing a degree of consumption due to oscillating operation of the magnetron 11 based on the heating time T1, which is a heat-cooking time, and a one-time oscillation time T' (corresponding to t1 in FIG. 4) of microwaves periodically generated in heating operation.

In this case, the heating time T1, which is a time duration for heat cooking, is set by the operation section 3 at a start of heating operation.

Assuming that the period of microwaves periodically generated from the magnetron 11 is Tc (3 sec. in this embodiment) and that the duty ratio is D, the one-time oscillation time T' of microwaves can be determined by $$T'=Tc\times D.$$

The duty ratio D, although set to 2.5 sec./3.0 sec. in this embodiment, yet may be changed in response to setting conditions of microwave power.

The number n of oscillations of microwaves during the heating time T1, which is a one-time heat cooking time, is determined by $$n=T1/Tc.$$

During the heating time T1, which is the heat cooking time, an actual total microwave oscillation time Tw is $$Tw=T'\times n.$$

In this case, the consumption time Ts representing a degree of consumption due to oscillating operation of the magnetron 11 calculated by the consumption time calculating part. 100*e* is $$Ts=T1+c\times Tw \text{ (c is a factor)}$$

$$=T1+c\times T'\times n$$

where the factor c is set in correspondence to the microwave duty ratio D.

When the magnetron 11 performs continuous oscillating operation, the consumption time Ts of the magnetron 11 calculated by the consumption time calculating part 100*e* is equal to the heating time T1, which is a heat cooking time.

In the microwave oven of the above configuration, the consumption time Ts of the magnetron 11 calculated by the consumption time calculating part 100*e* is not actual time of oscillating operation of the magnetron 11 under the condition that microwaves are periodically oscillated. Also, according as the duty ratio at which microwaves are periodically turned on and off decreases, the service life of the magnetron 11 becomes shorter than in the continuous oscillation. Thus, the consumption time Ts calculated by the consumption time calculating part 100*e* when microwaves are periodically oscillated becomes longer than the consumption time (=heating time T1) resulting from continuous oscillating operation of the magnetron 11.

The consumption times Ts of the magnetron 11 calculated by the consumption time calculating part 100*e* in the above-described way are totalized by the consumption time totalizing part 100*f*. Then, when the consumption time discrimination part 100*g* decides that the total consumption time value of the magnetron 11 obtained by the consumption time totalizing part 100*f* exceeds a preset consumption time discrimination criterion (1250 hours in this embodiment), a notice indicating that it is time to replace the magnetron 11 is displayed on the LCD part 7 as an example of a notification part, giving a notification to the user.

The notification part is not limited to the LCD part 7. Notification of the magnetron replacement timing to the user may be done by means of voice and the like or in combination of those means and a display part. As a result, in heat cooking in which microwaves from the magnetron 11 are periodically turned on and off, the replacement timing of the magnetron 11 can be notified correctly even if heat cooking processes with different duty ratios are frequently used.

The microwave oven of the fourth embodiment has similar effects to those of the microwave oven of the third embodiment.

Fifth Embodiment

Figure 9:
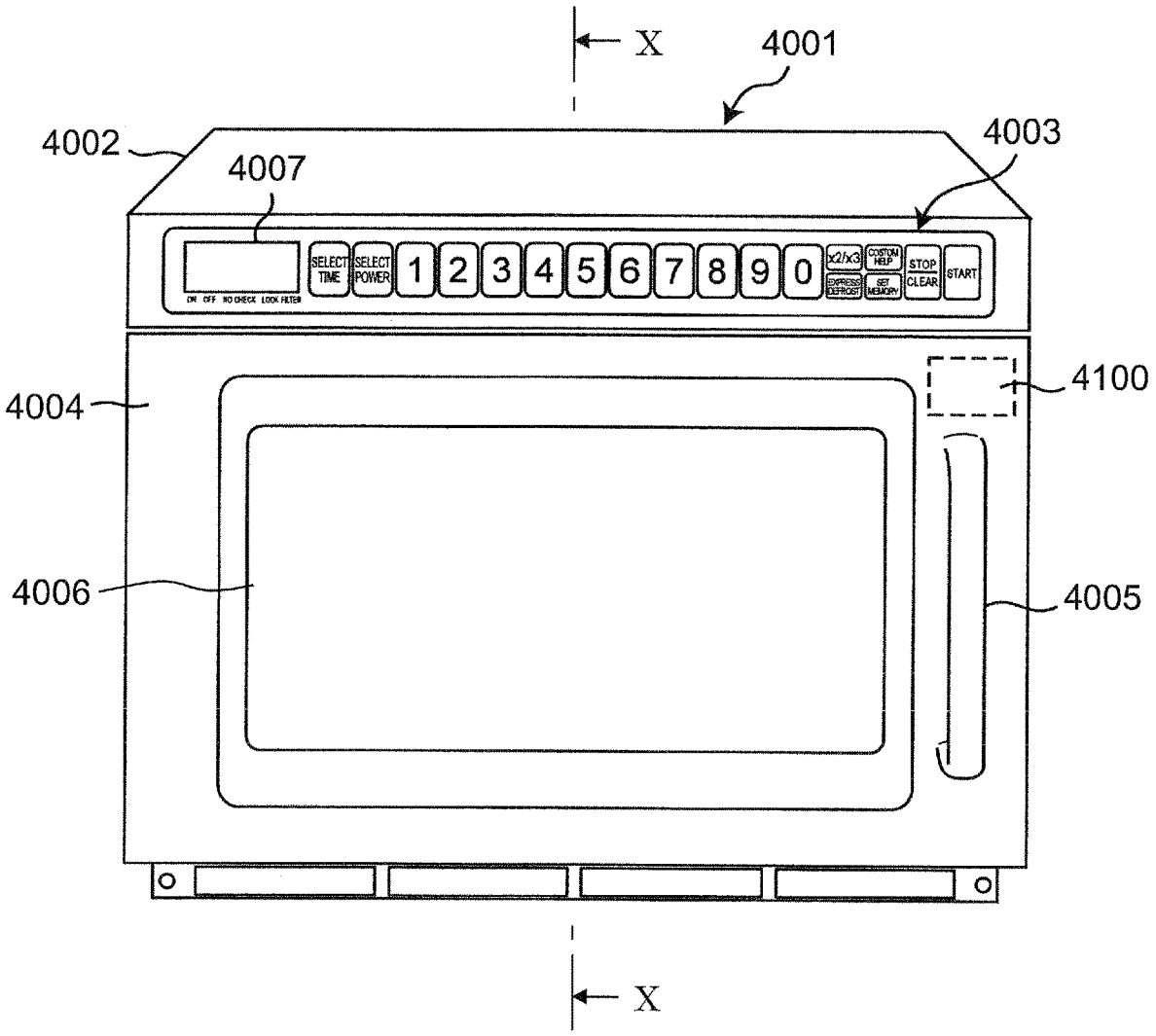
FIG. 9 is a front view of a microwave oven according to a fifth embodiment of the invention.

FIG. 9 is a front view of a microwave oven 4001 according to a fifth embodiment of the invention. The microwave oven 4001 of this fifth embodiment is to be mounted on an airplane equipped with a wireless LAN (Local Area Network).

In the microwave oven 4001 of the fifth embodiment, as shown in FIG. 9, an operation section 4003 is provided in a front upper part of a rectangular parallelepiped-shaped cabinet 4002. A door 4004 which is pivotable around a left end side to open and close a heating chamber 4010 (shown in FIG. 10) is provided below the operation section 4003 in the frontage of the cabinet 4002. A handle 4005 is provided at a right portion of the door 4004, and a window 4006 made from heat-resistant glass is fitted into the door 4004. Further, an LCD (Liquid Crystal Display) part 4007 is provided on the left side in the operation section 4003 as viewed in the figure. Operating a key in the operation section 4003 causes a content corresponding to the operation to be displayed on the LCD part 4007 by a control unit 4100.

Figure 10:
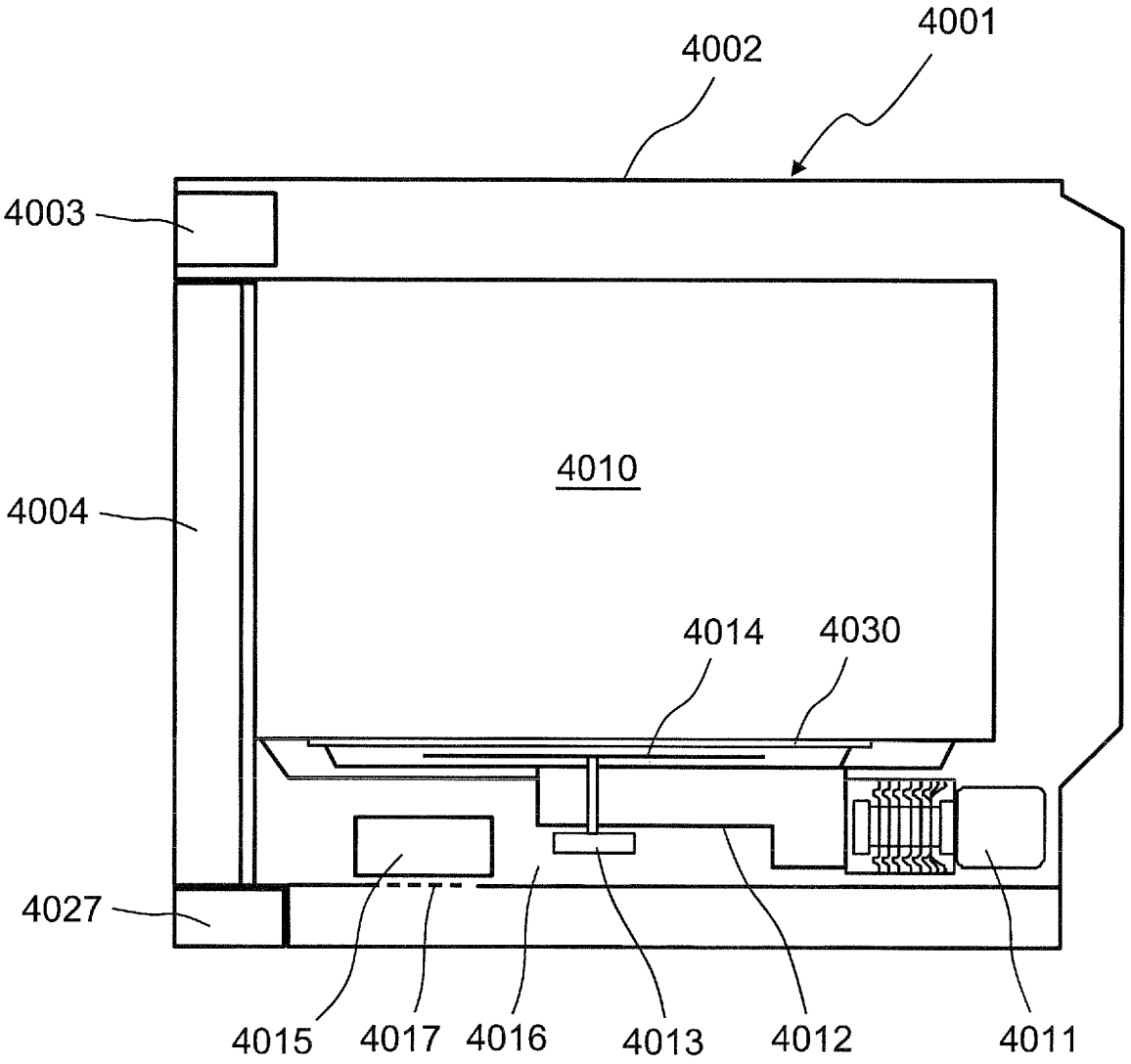
FIG. 10 is a sectional view taken along the line X-X of FIG. 9.

The microwave oven 4001 in this case is to heat a heating object placed in the heating chamber 4010 by means of microwaves generated by a magnetron 4011 (shown in FIG. 10). The structure for heating the heating object with microwaves is similar to that of conventional microwave ovens using microwaves.

FIG. 10 is a sectional view taken along the line X-X of FIG. 9. In FIG. 10, like component members in conjunction with FIG. 9 are designated by like reference signs. Reference sign 4027 denotes a refuse receiver.

As shown in FIG. 10, the heating chamber 4010 is placed in the cabinet 4002, and the magnetron 4011 is placed at a rear face-side lower portion below the heating chamber 4010 within the cabinet 4002. Microwaves generated by the magnetron 4011 are led by a waveguide 4012 to a center of the lower portion below the heating chamber 4010, and then radiated upward within the heating chamber 4010 while being rotated by a rotating antenna 4014 driven by a rotating-antenna motor 4013. Thus, the heating object on a bottom tray 4030 is heated.

Provided below the heating chamber 4010 in the cabinet 4002 is an outside-air inflow duct 4016 in which a cooling fan 4015, the waveguide 4012 and the magnetron 4011 are disposed. At a position facing the cooling fan 4015 on a lower surface of the outside-air inflow duct 4016, an outside-air inflow port 4017 is provided so that outside air is brought into the outside-air inflow duct 4016 through the outside-air inflow port 4017 by the operation of the cooling fan 4015.

Figure 11:
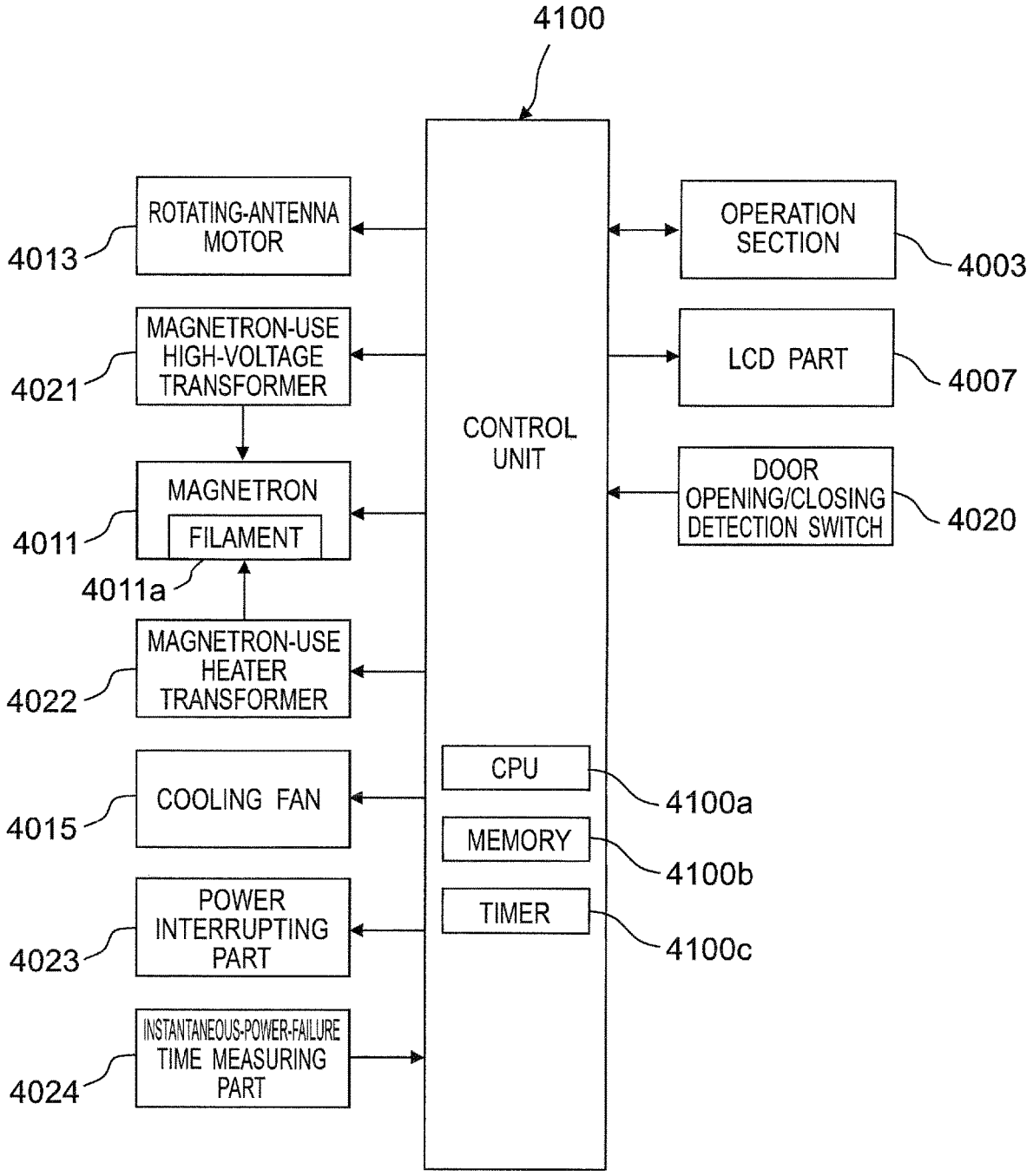
FIG. 11 is a block diagram showing an outlined configuration of a control unit of the microwave oven.

FIG. 11 shows an outlined configuration of the control unit 4100 of the microwave oven 4001 (shown in FIG. 9). The control unit 4100 includes a CPU (Central Processing Unit) 4100*a*, a memory 4100*b*, and a timer 4100*c*.

Based on signals from the operation section 4003, a door opening/closing detection switch 4020, an instantaneous-power-failure time measuring part 4024 and the like, the control unit 4100 controls the LCD part 4007, the rotating-antenna motor 4013, a magnetron-use high-voltage transformer 4021 which applies a high voltage to the magnetron 4011, a magnetron-use heater transformer 4022 which applies a voltage to a filament 4011*a* of the magnetron 4011, the cooling fan 4015, a power interrupting part 4023, the instantaneous-power-failure time measuring part 4024, and the like.

The magnetron-use high-voltage transformer 4021 and a first switch part (not shown) for turning on and off the AC voltage applied to the input side of the magnetron-use high-voltage transformer 4021 constitute a magnetron driving part. The magnetron-use heater transformer 4022 and a second switch part (not shown) for turning on and off the AC voltage applied to the input side of the magnetron-use heater transformer 4022 constitute a filament driving part.

Figure 12:
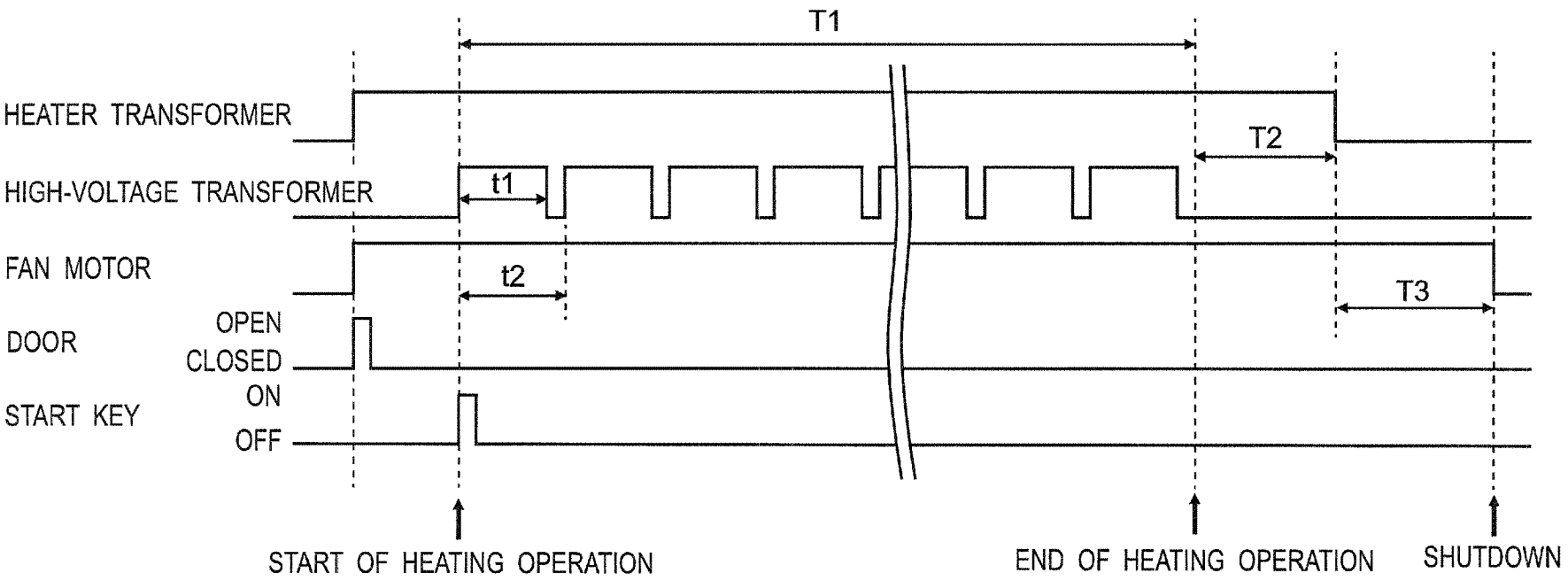
FIG. 12 is a timing chart of heating operation with microwaves in the microwave oven.

FIG. 12 is a timing chart of heating operation with microwaves in the microwave oven 4001. In FIG. 12, t1, t2, T1, T2 and T3 are made different from actual times for the sake of easier viewing of the drawing.

First, when the user opens or closes the door 4004 to set a heating object in the heating chamber 4010, opening/closing of the door 4004 is detected by the door opening/closing detection switch 4020. Upon reception of a signal indicative of the door 4004 having been opened from the door opening/closing detection switch 4020, the control unit 4100 starts voltage application to the filament 4011*a* via the magnetron-use heater transformer 4022. At this time point, the control unit 4100 drives the cooling fan 4015 (drives a fan motor shown in FIG. 12).

Next, heating operation is started by turning on the start key of the operation section 4003, so that a heating object is heated with microwaves periodically generated from the magnetron 4011. In this case, the magnetron 4011 repeats oscillation (t1=2.5 sec.) and stop (0.5 sec.) of microwaves. The period t2 of microwave oscillation in this case is 3.0 sec., and its duty ratio is t1/t2 (=2.5 sec./3.0 sec.). This periodical microwave oscillation makes it possible to prevent communication failures of the wireless LAN in the airplane.

Upon completion of the heating time T1, first, the oscillation of the magnetron 4011 is stopped, and then, after a first stop time T2 has passed, the voltage application to the magnetron-use heater transformer 4022 is stopped. After elapse of a second stop time T3 from the stop of the voltage application to the filament 4011*a*, the cooling fan 4015 is stopped and moreover the power supply input is interrupted (shutdown) by the power interrupting part 4023.

Figure 13:
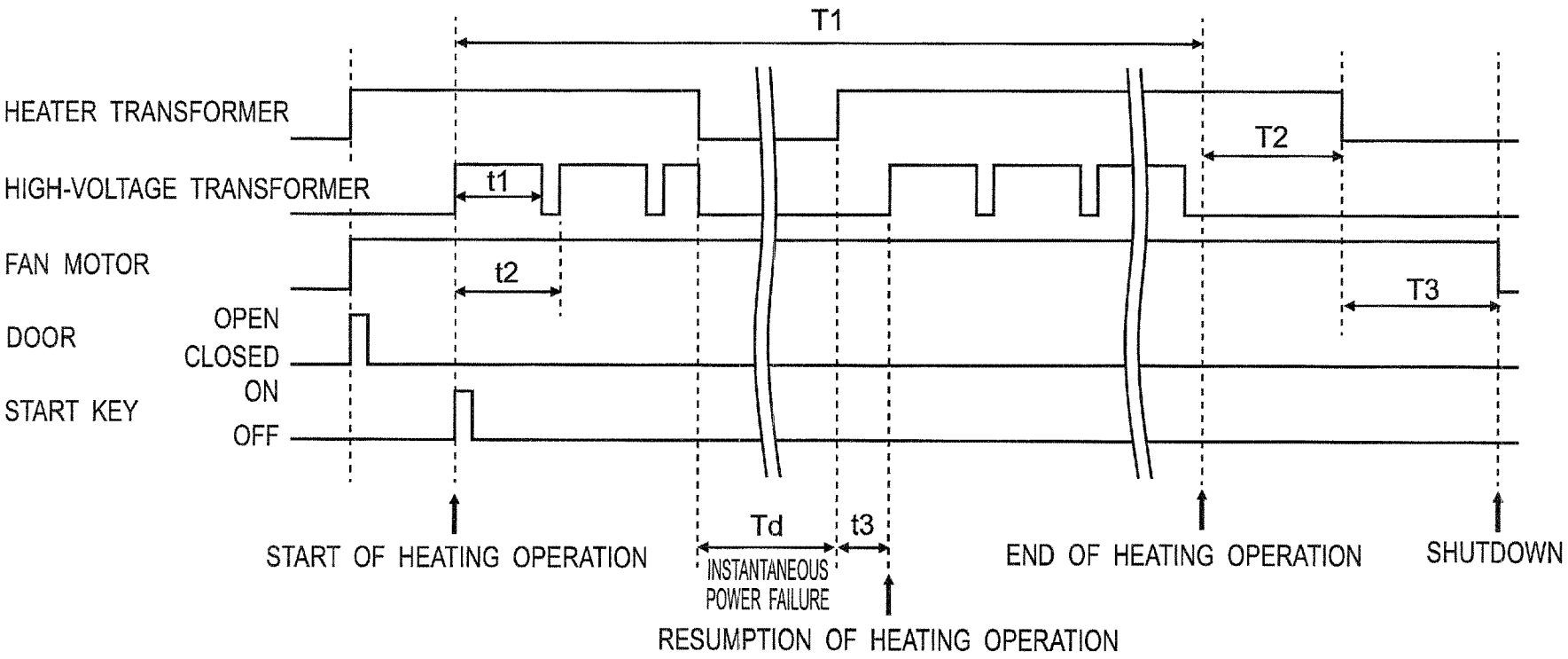
FIG. 13 is a timing chart for process upon occurrence of instantaneous power failure during heating operation of the microwave oven.

FIG. 13 is a timing chart for process upon occurrence of instantaneous power failure during heating operation of the microwave oven 4001. Operations or actions in FIG. 13 except during the instantaneous power failure are same as those during the heating operation shown in FIG. 12. In FIG. 13, t1, t2, t3, T1, T2, T3 and Td are different from actual times for the sake of easier viewing of the drawing.

As shown in FIG. 13, when the power supply input is recovered after instantaneous power failure during heating operation in which the heating object is heated with microwaves periodically generated from the magnetron 4011, preheating is started by applying a voltage to the filament 4011*a* via the magnetron-use heater transformer 4022 at a time point which is earlier by a specified post-recovery-from-instantaneous-power-failure preheating time (which is a preheating time after recovery from instantaneous power failure) t3 than a time point at which the high voltage is applied to the magnetron 4011 via the magnetron-use high-voltage transformer 4021.

Preheating the filament 4011*a* before applying high voltage to the magnetron 4011 for its oscillation allows the magnetron 4011 to be oscillated reliably without incurring the moding state of the magnetron 4011 after recovery from instantaneous power failure.

An optimum preheating time corresponding to a degree of temperature decrease of the filament 4011*a* is set by determining the post-recovery-from-instantaneous-power-failure preheating time t3 based on an instantaneous power failure time Td measured by the instantaneous-power-failure time measuring part 4024. As a result of this, the filament 4011*a* can be set to an optimum temperature for oscillation of the magnetron 4011 after the recovery from instantaneous power failure.

The post-recovery-from-instantaneous-power-failure preheating time t3 may be determined based on the elapsed time since a start of voltage application to the filament 4011*a* or on a temperature of the filament 4011*a*. In this case also, it is possible to set an optimum preheating time corresponding to the degree of temperature decrease of the filament 4011*a*.

According to the microwave oven of the above-described configuration, when the power supply input is recovered to resume heating operation after instantaneous power failure during heating operation in which the heating object is heated with microwaves periodically generated from the magnetron 4011, preheating is started by the control unit 4100 by applying the voltage to the filament 4011*a* from the magnetron-use heater transformer 4022 (filament driving part) at a time point which is earlier by a preset post-recovery-from-instantaneous-power-failure preheating time t3 than a time point at which the high voltage is applied to the magnetron 4011 from the magnetron-use high-voltage transformer 4021 (magnetron driving part). Thus, by preheating the filament 4011*a* before applying high voltage to the magnetron 4011 for its oscillation, the magnetron 4011 can be oscillated reliably without incurring the moding state of the magnetron 4011.

When the power supply input is recovered to resume heating operation after instantaneous power failure during heating operation in which the heating object is heated with microwaves periodically generated from the magnetron 4011, and moreover when the instantaneous power failure time Td measured by the instantaneous-power-failure time measuring part 4024 is equal to or more than a preset time for discrimination, voltage application to the filament 4011*a* from the magnetron-use heater transformer 4022 is started by the control unit 4100 at a time point which is earlier by a post-recovery-from-instantaneous-power-failure preheating time t3 than a time point at which the high voltage is applied to the magnetron 4011 from the magnetron-use high-voltage transformer 4021. As a result of this, the magnetron 4011 can be oscillated with the high voltage applied thereto with execution of the preheating of the filament 4011*a* by the magnetron-use heater transformer 4022 in cases of such long instantaneous power failure time Td as causes temperature decrease of the filament 4011*a*, or without execution of the preheating of the filament 4011*a* by the magnetron-use heater transformer 4022 in cases of such short instantaneous power failure time Td as allows the filament 4011*a* to be maintained to be enough preheated. In this way, preheating of the filament 4011*a* is controlled depending on whether the instantaneous power failure time Td is short or long, so that excess preheating of the filament 4011*a* can be saved.

Since the temperature of the filament 4011*a* decreases more and more with the increasing instantaneous power failure time Td, an optimum preheating time corresponding to a degree of temperature decrease of the filament 4011*a* can be set by determining the post-recovery-from-instantaneous-power-failure preheating time t3 based on the instantaneous power failure time Td measured by the instantaneous-power-failure time measuring part 4024.

In the case where the power supply input is automatically interrupted to reduce the standby-state power consumption after an end of the heating operation, when the voltage application to the filament 4011*a* and the cooling fan 4015 are simultaneously stopped, the temperature of the filament 4011*a* increases to an overshooting extent, causing the service life of the magnetron 4011 to be shortened due to temperature variations of the filament 4011*a*.

Therefore, according to the fifth embodiment, when the power supply input is interrupted by the power interrupting part 4023, high-voltage application to the magnetron 4011 is first stopped. Then, after elapse of the first stop time, voltage application to the filament 4011*a* by the magnetron-use heater transformer 4022 is stopped. Then, after elapse of the second stop time, the cooling fan 4015 is stopped, and the power supply input is interrupted by the power interrupting part 4023. Thus, temperature increases of the filament 4011*a* to an overshooting extent is prevented from occurring upon interruption of the power supply input by the power interrupting part 4023, so that the service life of the magnetron 4011 is allowed to be prolonged.

Sixth Embodiment

Figure 14:
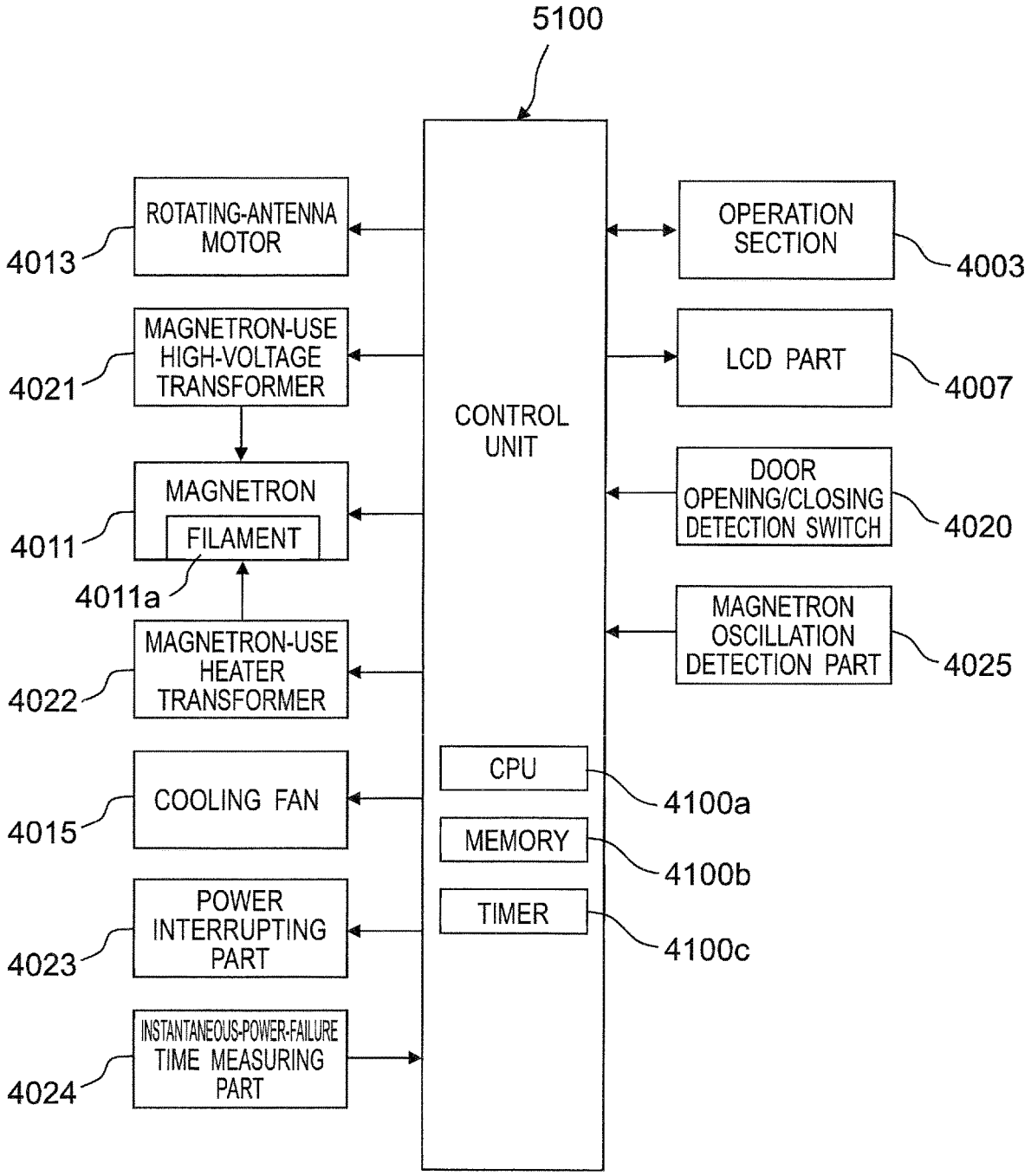
FIG. 14 is a block diagram showing an outlined configuration of a control unit of a microwave oven according to a sixth embodiment of the invention.

FIG. 14 shows an outlined configuration of a control unit 5100 of a microwave oven according to a sixth embodiment of the invention. Except for operations of a magnetron oscillation detection part 4025 and the control unit 5100, the microwave oven of this sixth embodiment is similar in configuration to the microwave oven 4001 of the fifth embodiment, and so FIGS. 9 and 10 are used also for this embodiment.

The microwave oven of the sixth embodiment includes a magnetron oscillation detection part 4025 which detects oscillation of the magnetron 4011. The magnetron oscillation detection part 4025 detects the presence or absence of oscillation of the magnetron 4011 based on a primary-side input current (or a secondary-side output current) of the magnetron-use high-voltage transformer 4021. The magnetron oscillation detection part may also be one using a detection means which detects microwaves derived from the magnetron or the like.

Based on signals from the operation section 4003, the door opening/closing detection switch 4020, the instantaneous-power-failure time measuring part 4024, the magnetron oscillation detection part 4025 and the like, the control unit 5100 controls the LCD part 4007, the rotating-antenna motor 4013, the magnetron-use high-voltage transformer 4021, the magnetron-use heater transformer 4022, the cooling fan 4015, and the like.

Figure 15:
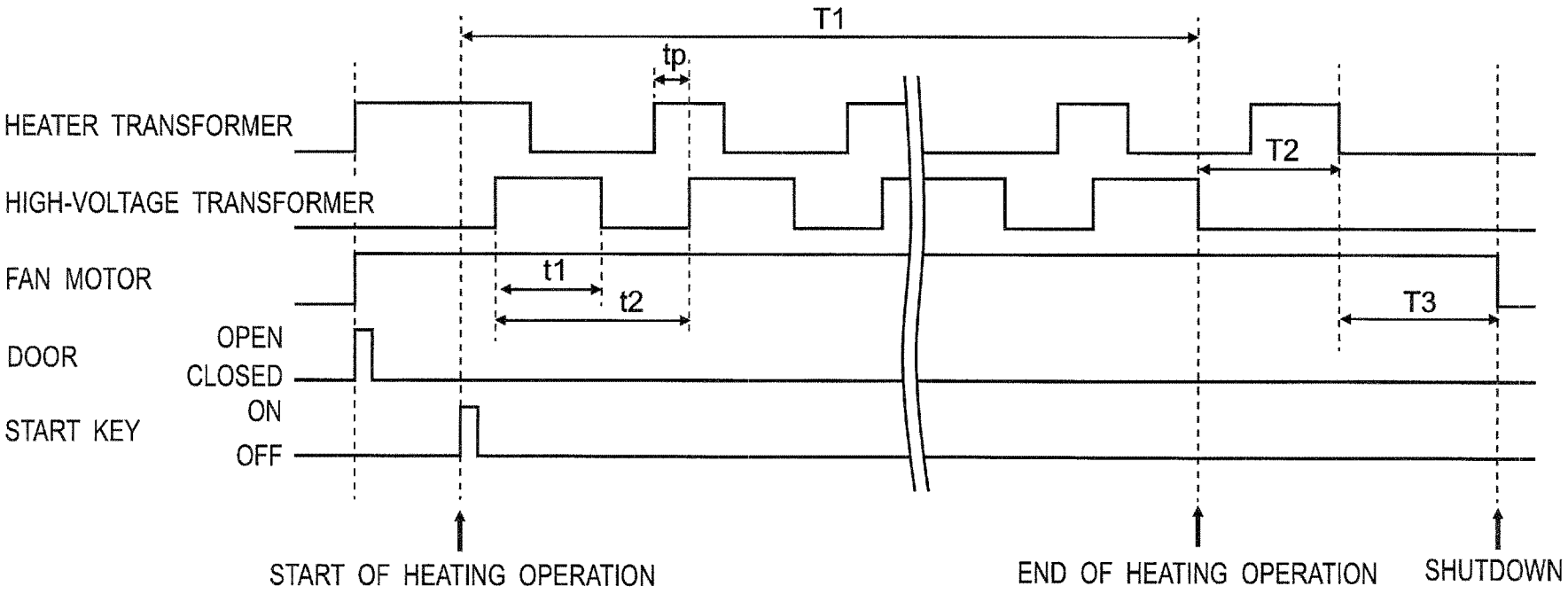
FIG. 15 is a timing chart of heating operation with microwaves in the microwave oven.

FIG. 15 is a timing chart of heating operation with microwaves in the microwave oven. Except for the timing of voltage application to the filament 4011*a*, the timing chart of FIG. 15 is generally identical to the timing chart shown in FIG. 12 of the fifth embodiment. In FIG. 15, t1, t2, T1, T2 and T3 are made different from actual time for the sake of easier viewing of the drawing.

As shown in FIG. 15, each time the voltage is periodically applied to the filament 4011*a* via the magnetron-use heater transformer 4022, a preheating time tp for the filament 4011*a* is ensured before the high-voltage application to the magnetron 4011, where if oscillation of the magnetron 4011 is detected by the magnetron oscillation detection part 4025, the voltage application to the filament 4011*a* is ended. By doing so, the temperature of the filament 4011*a*, which would be increased by the oscillation of the magnetron 4011 if the voltage application to the filament 4011*a* is maintained, is prevented from being increased, by the oscillation of the magnetron 4011, higher than that during preheating, so that a difference between the temperature of the filament 4011*a* in the preheated state and the temperature of the filament 4011*a* in the oscillation state of the magnetron 4011 may be lessened. By thus lessening temperature variations of the filament 4011*a* of the magnetron 4011, the service life of the magnetron 4011 can be prolonged.

Figure 16:
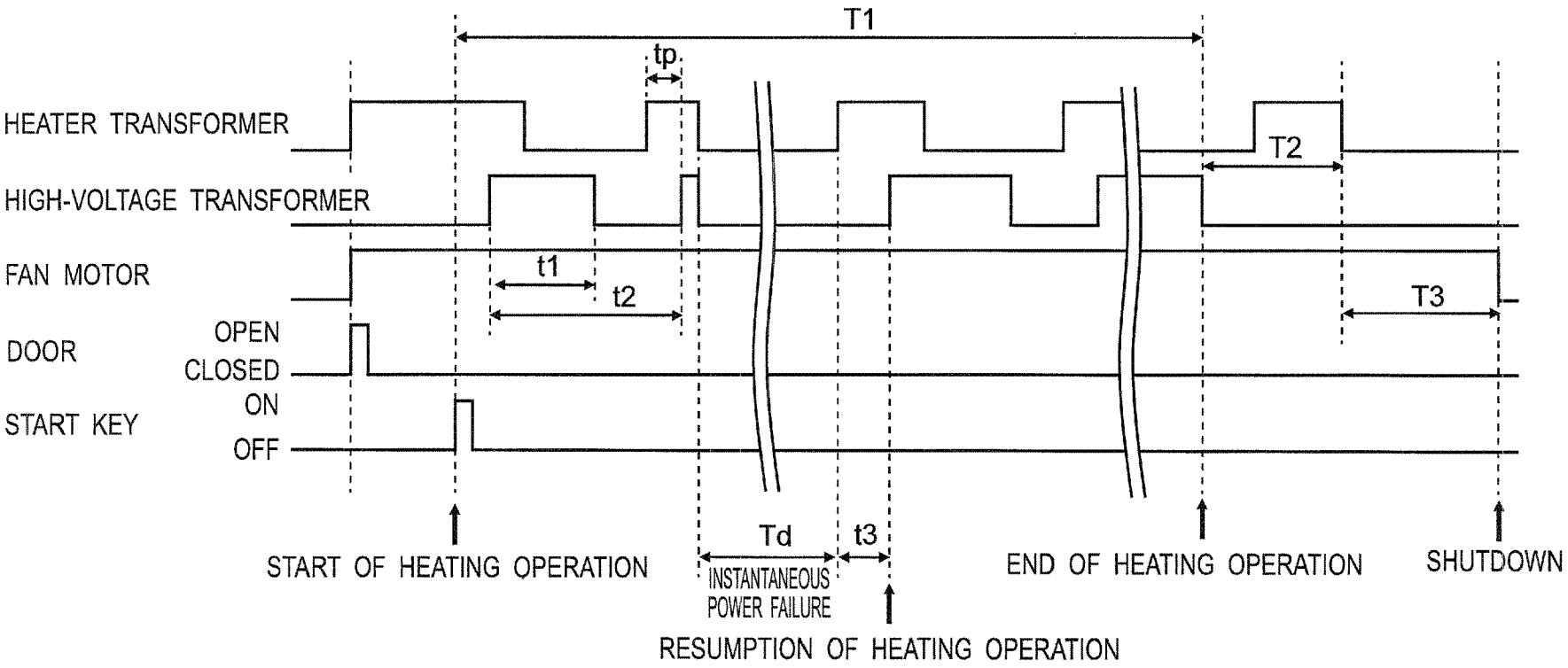
FIG. 16 is a timing chart for process upon occurrence of instantaneous power failure during heating operation of the microwave oven.

FIG. 16 is a timing chart for process upon occurrence of instantaneous power failure during heating operation of the microwave oven. Operations or actions in FIG. 16 except during the instantaneous power failure are same as those during the heating operation shown in FIG. 15. In FIG. 16, t1, t2, t3, T1, T2, T3 and tp are made different from actual time for the sake of easier viewing of the drawing.

As shown in FIG. 16, when the power supply input is recovered after instantaneous power failure during heating operation in which the heating object is heated with microwaves periodically generated from the magnetron 4011, preheating is started by applying the voltage to the filament 4011*a* via the magnetron-use heater transformer 4022 at a time point which is earlier by a specified post-recovery-from-instantaneous-power-failure preheating time t3 than a time point at which the high voltage is applied to the magnetron 4011 via the magnetron-use high-voltage transformer 4021. In this case, the post-recovery-from-instantaneous-power-failure preheating time t3 is determined based on an instantaneous power failure time Td measured by the instantaneous-power-failure time measuring part 4024, where the post-recovery-from-instantaneous-power-failure preheating time t3 is longer than the preheating time tp.

By thus heating the filament 4011*a* before oscillating the magnetron 4011 with the high voltage applied thereto, the magnetron 4011 is oscillated reliably without incurring its moding state after the recovery from instantaneous power failure.

According to the microwave oven of the above-described configuration, similar effects to those of the microwave oven 4001 of the fifth embodiment are obtained.

Seventh Embodiment

Figure 17A:
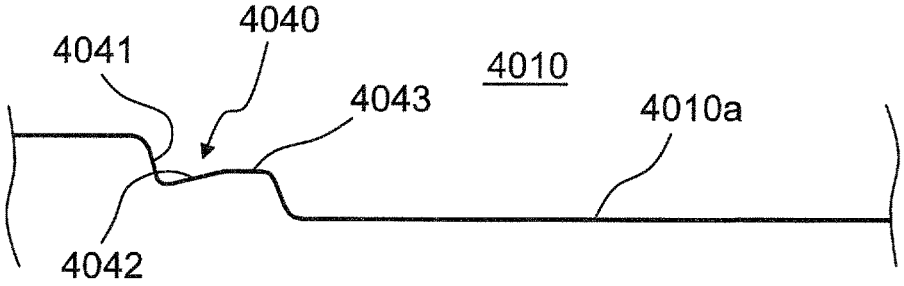
FIG. 17A is a schematic sectional view of an important part of a bottom of a heating chamber of a microwave oven according to a seventh embodiment of the invention.

FIG. 17A is a schematic sectional view of an important part in a bottom portion of a heating chamber 4010 of a microwave oven according to a seventh embodiment of the invention. Except for a bottom tray fitting structure of the heating chamber 4010, the microwave oven of this seventh embodiment is similar in configuration to the microwave oven 4001 of the fifth embodiment, and so FIGS. 9 and 10 are used also in this embodiment.

As shown in FIG. 17A, there is provided a step portion 4040 for fixing the bottom tray 4030 (shown in FIG. 10) at an outer peripheral edge of a rotating-antenna recessed portion 4010*a* provided at the bottom of the heating chamber 4010. This step portion 4040 has a side wall 4041, an inclined portion 4042 gradually heightening from a lower end of the side wall 4041 toward inside, and a flat portion 4043 extending from an inner peripheral side of the inclined portion 4042 toward inside.

Figure 17B:
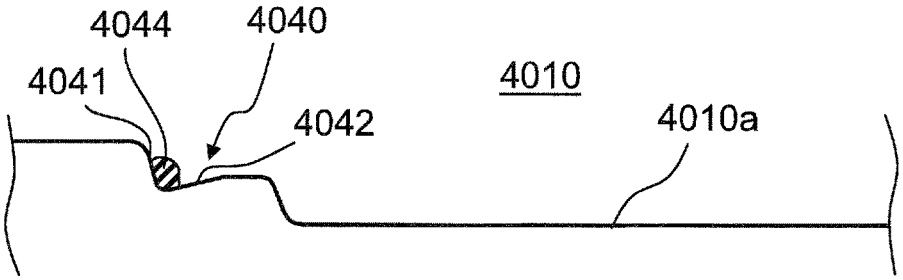
FIG. 17B is a schematic sectional view showing a state in which adhesive for fixing a bottom tray to a rotating-antenna recessed portion of the heating chamber is applied.

Next, as shown in FIG. 17B, an adhesive 4044 for fixing the bottom tray 4030 (shown in FIG. 10) to the rotating-antenna recessed portion 4010*a* of the heating chamber 4010 is applied to the side wall 4041 side of the inclined portion 4042.

Figure 17C:
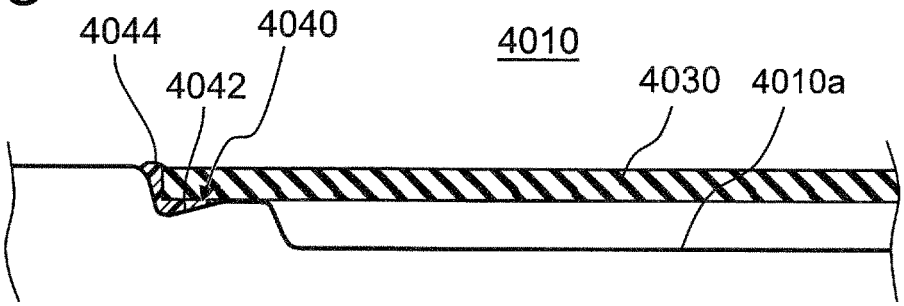
FIG. 17C is a schematic sectional view showing a state in which the bottom tray has been fixed to the rotating-antenna recessed portion of the heating chamber.

Next, as shown in FIG. 17C, the bottom tray 4030 is fixed to the rotating-antenna recessed portion 4010*a* of the heating chamber 4010. In this case, the adhesive 4044 is filled between a side face of the outer peripheral portion of the bottom tray 4030 and the side wall 4041 of the step portion 4040 as well as between a lower surface portion near the side face of the outer peripheral portion of the bottom tray 4030 and the inclined portion 4042 of the step portion 4040.

In this way, the adhesive is provided all over a space between the lower surface of the bottom tray 4030 and the inclined surface of the inclined portion 4042 of the step portion 4040 so that enough retaining force and adhesion can be obtained.

Figure 19:
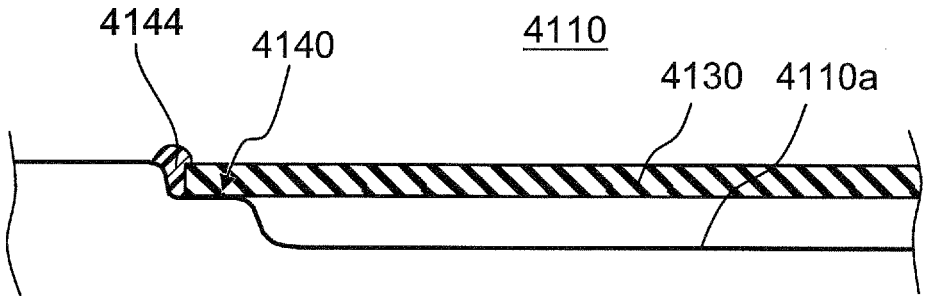
FIG. 19 is a schematic sectional view showing a bottom tray fitting structure in a heating chamber of a microwave oven according to prior art.

In a conventional bottom tray fitting structure, as shown in FIG. 19, there would be provided a step portion 4140 for fixing a bottom tray 4130 at an outer peripheral edge of the rotating-antenna recessed portion 4110*a* provided at the bottom of a heating chamber 4110. With such a bottom tray fitting structure, in cases where workability is taken into consideration, the bottom tray 4130 is fixed to the rotating-antenna recessed portion 4110*a* of the heating chamber 4010 before an adhesive 4144 is filled between a side wall of the step portion 4140 and a side face of the outer peripheral portion of the bottom tray 4130. For this reason, there have been such problems as insufficient retaining force or adhesion by the adhesive 4144 and swelling of the adhesive 4144 upward of the plane of the bottom tray 4130.

In contrast to this, with the bottom tray fitting structure of the microwave oven of the seventh embodiment, the adhesive 4044 can be applied before the fitting operation of the bottom tray 4030, so that the workability is improved and moreover enough retaining force and adhesion by the adhesive 4044 can be obtained. Since the adhesive 4044 is applied to the step portion 4040 before the fitting of the bottom tray 4030, the amount of the adhesive 4044 can be controlled properly, so that swelling of the adhesive 4044 can also be suppressed.

The seventh embodiment has been described focusing on the bottom tray fitting structure shown in FIGS. 17A to 17C. However, without being limited to this, the bottom tray fitting structure may be another one such as a bottom tray fitting structure of an eighth embodiment shown in FIG. 18.

Eighth Embodiment

Figure 18:
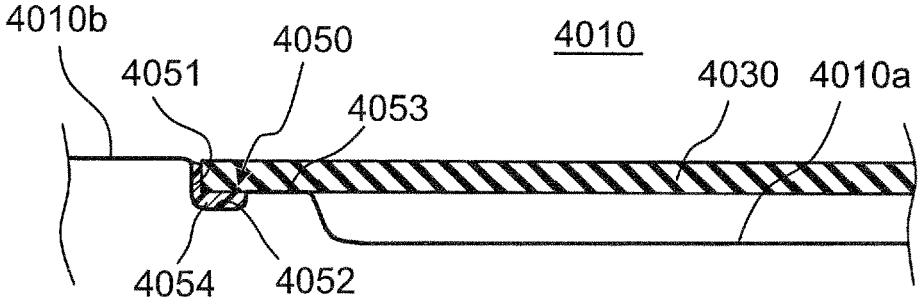
FIG. 18 is a schematic sectional view of an important part of a bottom portion of a heating chamber of a microwave oven according to an eighth embodiment of the invention.

FIG. 18 is a schematic sectional view of an important part of a bottom portion of a heating chamber 4010 of a microwave oven according to an eighth embodiment of the invention. Except for a bottom tray fitting structure of the heating chamber 4010, the microwave oven of this eighth embodiment is similar in configuration to the microwave oven 4001 of the fifth embodiment, and so FIGS. 9 and 10 are used also in this embodiment.

As shown in FIG. 18, there is provided a step portion 4050 for fixing the bottom tray 4030 (shown in FIG. 10) at an outer peripheral edge of the rotating-antenna recessed portion 4010*a* provided at the bottom of the heating chamber 4010. This step portion 4050 has a side wall 4051, a groove portion 4052 with its wall surface given by the side wall 4051, and a flat portion 4053 which extends from an inner peripheral side of the groove portion 4052 toward inside and which is higher than the bottom face of the groove portion 4052 and lower than a bottom face 4010*b* of the bottom portion of the heating chamber 4010.

An adhesive 4054 for fixing the bottom tray 4030 (shown in FIG. 10) to the rotating-antenna recessed portion 4010*a* of the heating chamber 4010 is applied to the bottom side of the groove portion 4052.

Next, the bottom tray 4030 is fixed to the rotating-antenna recessed portion 4010*a* of the heating chamber 4010. In this case, the adhesive 4054 is filled between a side face of the outer peripheral portion of the bottom tray 4030 and the side wall 4051 of the step portion 4050 as well as between a lower surface portion near the side face of the outer peripheral portion of the bottom tray 4030 and the groove portion 4052 of the step portion 4050.

In this way, the adhesive is provided all over a space between the lower surface of the bottom tray 4030 and the groove portion 4052 of the step portion 4050 so that enough retaining force and adhesion can be obtained.

According to the bottom tray fitting structure of the microwave oven of the eighth embodiment, the adhesive 4054 can be applied before the fitting of the bottom tray 4030, so that the workability is improved and moreover enough retaining force and adhesion by the adhesive 4054 can be obtained. Since the adhesive 4054 is applied to the step portion 4050 before the fitting of the bottom tray 4030, the amount of the adhesive 4054 can be controlled properly, so that swelling of the adhesive 4054 can also be suppressed.

Ninth Embodiment

Figure 20:
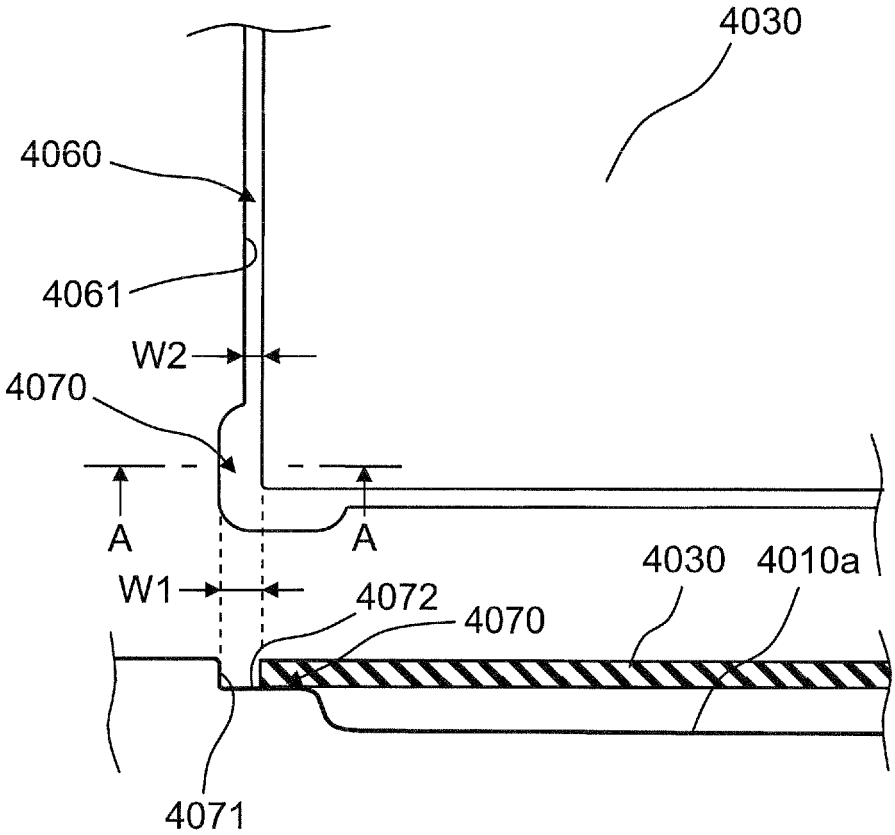
FIG. 20 shows, on its upper side, a plan view of an important part of a bottom portion of a heating chamber of a microwave oven according to a ninth embodiment of the invention and, on its lower side, a sectional view taken along the line A-A.

FIG. 20 shows, on its upper side, a plan view of an important part of a bottom portion of a heating chamber 4010 of a microwave oven according to a ninth embodiment of the invention and, on its lower side, a sectional view taken along the line A-A. Except for the bottom tray fitting structure of the heating chamber 4010, the microwave oven of this ninth embodiment is similar in configuration to the microwave oven 4001 of the fifth embodiment, and so FIGS. 9 and 10 are used also in this embodiment.

As shown in FIG. 20, a step portion 4070 is provided at least one of four corner portions of a rectangular-shaped outer peripheral edge of the rotating-antenna recessed portion 4010*a* provided at the bottom of the heating chamber 4010 (shown in FIG. 10). Moreover, a step portion 4060 for fixing the bottom tray 4030 (shown in FIG. 10) is provided at remaining portions of the outer peripheral edge other than the step portion 4070. The step portion 4070 has a side wall 4071, and a flat portion 4072 extending from a lower end of the side wall 4071 toward inside. A distance W1 between the side wall 4071 of the corner-side step portion 4070 and the side wall of the bottom tray 4030 is larger than a distance W2 between a side wall 4061 of the step portion 4060 and the side wall of the bottom tray 4030.

Figure 22:
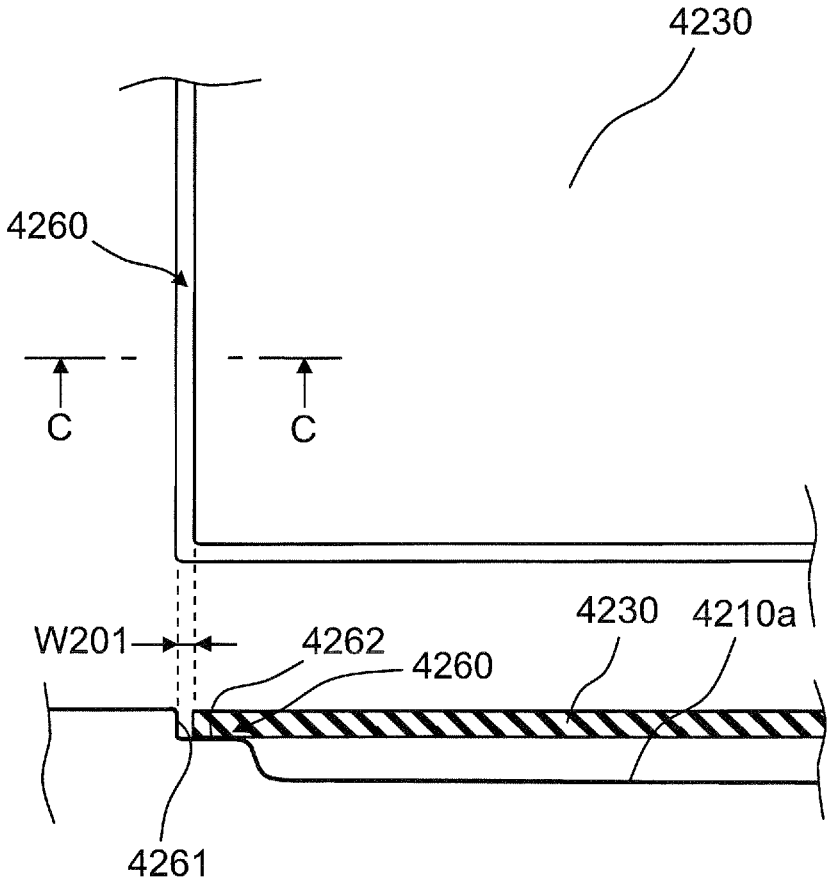
FIG. 22 shows, on its upper side, a plan view of an important part of a bottom portion of a heating chamber of a microwave oven according to prior art and, on its lower side, a sectional view taken along the line C-C.

FIG. 22 shows, on its upper side, a conventional bottom tray fitting structure and, on its lower side, a sectional view taken along the line C-C. In this conventional bottom tray fitting structure, as shown in FIG. 22, there is provided a step portion 4260 for fixing a bottom tray 4230 at the outer peripheral edge of a rotating-antenna recessed portion 4210*a* provided at the bottom of the heating chamber. With such a bottom tray fitting structure, on occasions of replacement of the rotating antenna, the heater and the like located below the bottom tray 4230, it was quite hard to remove the adhesive (not shown) because of a narrow distance W201 between a side wall 4261 of the step portion 4260 and the side wall of the bottom tray 4230. For this reason, it was necessarily required to replace the microwave oven as a whole for a component or components thereof such as the rotating antenna and the heater.

In contrast, according to the bottom tray fitting structure of the microwave oven of the ninth embodiment, as shown in FIG. 20, the distance W1 between the side wall 4071 of the corner-side step portion 4070 and the side wall of the bottom tray 4030 is increased so as to enable easier access of tools to the step portion 4070, so that removal of the adhesive and therefore removal of the bottom tray 4030 can be easily fulfilled.

Tenth Embodiment

Figure 21:
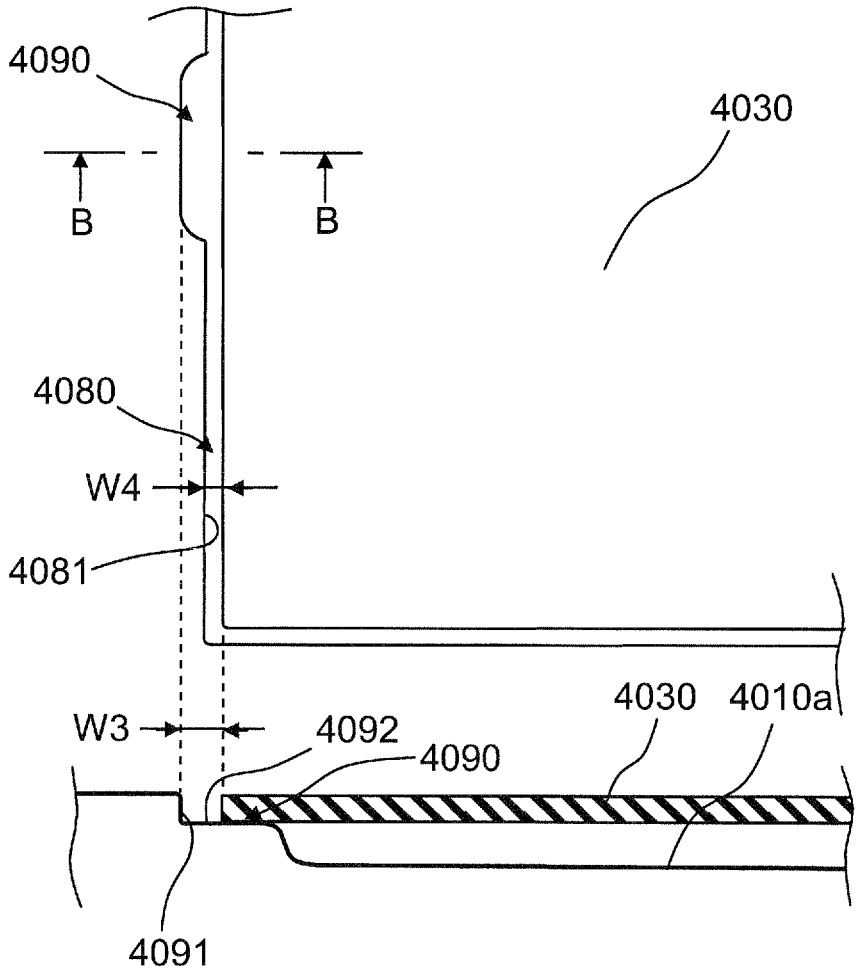
FIG. 21 shows, on its upper side, a plan view of an important part of a bottom portion of a heating chamber of a microwave oven according to a tenth embodiment of the invention and, on its lower side, a sectional view taken along the line B-B.

FIG. 21 shows, on its upper side, a plan view of an important part of a bottom portion of a heating chamber 4010 of a microwave oven according to a tenth embodiment of the invention and, on its lower side, a sectional view taken along the line B-B. Except for the bottom tray fitting structure of the heating chamber 4010, the microwave oven of this tenth embodiment is similar in configuration to the microwave oven 4001 of the fifth embodiment, and so FIGS. 9 and 10 are used also in this embodiment.

As shown in FIG. 21, a step portion 4090 is provided at a center portion of at least one side of a rectangular-shaped outer peripheral edge of the rotating-antenna recessed portion 4010*a* provided at the bottom of the heating chamber 4010 (shown in FIG. 10). Moreover, a step portion 4080 for fixing the bottom tray 4030 (shown in FIG. 10) is provided at remaining portions of the outer peripheral edge other than the step portion 4090. The step portion 4090 has a side wall 4091, and a flat portion 4092 extending from a lower end of the side wall 4091 toward inside. A distance W3 between the side wall 4091 of the step portion 4090 and the side wall of the bottom tray 4030 is larger than a distance W4 between a side wall 4081 of the step portion 4080 and the side wall of the bottom tray 4030.

According to the bottom tray fitting structure of the microwave oven of the tenth embodiment, the distance W3 between the side wall 4091 of the step portion 4090 at a center of the side and the side wall of the bottom tray 4030 is increased so as to enable easier access of tools to the step portion 4090, so that removal of the adhesive and therefore removal of the bottom tray 4030 can be easily fulfilled.

The foregoing first to tenth embodiments have been described about microwave ovens to be mounted on airplanes. However, without being limited to this, the invention is applicable to microwave ovens to be used under various environments.

The fifth to tenth embodiments have been described about microwave ovens mounted on an airplane equipped with a wireless LAN. However, without being limited to this, the invention may be applied to microwave ovens to be used under various environments such as wireless LAN spots.

The fifth to tenth embodiments have been described about microwave ovens in which a heating object is heated with microwaves periodically generated from the magnetron 4011. However, the microwave oven of the invention is not limited to this, and the invention may also be applied to microwave ovens in which a heating object is heated with microwaves continuously generated from the magnetron 4011.

Although concrete embodiments of the invention have been described above, yet the invention is not limited to the foregoing first to tenth embodiments and the invention may be carried out with various changes and modifications within the scope of the invention.

The invention and its embodiments can be summarized as follows.

A microwave oven according to the invention comprises:

a magnetron 11, 4011 which generates microwaves to heat a heating object; and a control unit 100, 1100, 2100, 3100, 4100, 5100 which controls the magnetron 11, 4011, wherein during heating operation in which the heating object is heated with microwaves generated from the magnetron 11, 4011, the control unit 100, 1100, 2100, 3100, 4100, 5100 controls the magnetron 11, 4011 so as to suppress abnormal operations of the magnetron 11, 4011 in response to a status of power supply supplied from outside.

With this arrangement, during heating operation with microwaves, the magnetron 11, 4011 is controlled in response to a status of power supply supplied from outside such that abnormal operation of the magnetron 11, 4011 is suppressed. Thus, it is implementable, for example, to prevent abnormal operation of the magnetron 11, 4011 even if the frequency of the power supply voltage has largely varied in the heating operation with microwaves, as well as to oscillate the magnetron 11, 4011 reliably without incurring its moding state after recovery from instantaneous power failure.

In this case, the "status of power supply" may include not only the frequency variation of the power supply voltage and the instantaneous power failure but also variation of the power supply voltage.

In one embodiment, in the microwave oven as defined above, the magnetron 11 generates microwaves by power supply voltage supplied from outside, and the microwave oven further comprises:

a frequency detection part 23 which detects a frequency of the power supply voltage; and a frequency discrimination part 100*b* which discriminates whether or not the frequency of the power supply voltage detected by the frequency detection part 23 is within a preset frequency range, wherein during heating operation in which the heating object is heated with microwaves generated from the magnetron 11; the control unit 100, 1100, 2100, 3100 stops oscillation of the magnetron 11 when the frequency discrimination part 100*b* decides that the frequency of the power supply voltage is not within the preset frequency range.

According to this embodiment, during heating operation in which a heating object is heated with microwaves generated from the magnetron 11, when the frequency discrimination part 100*b* has decided that the frequency of the power supply voltage is not within the preset frequency range, the oscillation of the magnetron 11 is stopped by the control unit 100, 1100, 2100, 3100. Therefore, even if the frequency of the power supply voltage has largely varied during the heating operation with microwaves, abnormal operation of the magnetron 11 can be prevented. It is also possible to oscillate the magnetron 11 normally again when the frequency discrimination part 100*b* decides that the frequency of the power supply voltage has become within the preset frequency range after the oscillation stop of the magnetron 11.

In one embodiment, in the microwave oven as defined above, when the frequency discrimination part 100*b* decides that the frequency of the power supply voltage has become within the frequency range after an oscillation stop of the magnetron 11 during the heating operation, the control unit 100, 1100, 2100, 3100 makes the magnetron 11 oscillated to resume the heating operation.

According to this embodiment, when the frequency discrimination part 100*b* decides that the frequency of the power supply voltage has become within the frequency range after an oscillation stop of the magnetron 11 in the heating operation, the control unit 100, 1100, 2100, 3100 makes the magnetron 11 oscillated to resume the heating operation. Therefore, even if the frequency of the power supply voltage varies so largely that the magnetron 11 is temporarily stopped, the heat cooking can be completed.

In one embodiment, the microwave oven as defined above further comprises:

an oscillation-stop time measuring part 24 which measures an oscillation stop time of the magnetron 11 in the heating operation; and a heating time correcting part 100*c* which, after an oscillation stop of the magnetron 11 in the heating operation, corrects remaining heating time of the heating operation based on the oscillation stop time of the magnetron 11 measured by the oscillation-stop time measuring part 24 when the heating operation is resumed upon a decision by the frequency discrimination part 100*b* that the frequency of the power supply voltage has become within the frequency range.

According to this embodiment, after an oscillation stop of the magnetron 11 in heating operation, when the heating operation is resumed upon a decision by the frequency discrimination part 100*b* that a frequency of the power supply voltage has become within the frequency range, the remaining heating time of the heating operation is corrected by the heating time correcting part 100*c* based on the oscillation stop time of the magnetron 11 measured by the oscillation-stop time measuring part 24. Therefore, even if the oscillation of microwaves is stopped during heating operation, the remaining heating is carried out with the heating time corrected in correspondence to the oscillation stop time. Thus, for example, since the heating object is cooled more and more with increasing oscillation stop time, prolonging the remaining heating time makes it possible to complete the heating operation without deteriorating the heating quality.

In one embodiment, the microwave oven as defined above further comprises a load capacity discrimination part 100*d* which discriminates as to a load capacity of the microwaves, wherein the control unit 2100, 3100 sets a first oscillation mode in which microwaves are periodically generated from the magnetron 11 when the load capacity discrimination part 100*d* decides that the load capacity of the microwaves is equal to or lower than a preset load capacity discrimination criterion, and sets a second generated from the magnetron 11 when the load capacity discrimination part 100*d* decides that a load capacity of the microwaves detected by the load capacity discrimination part 100*d* is larger than the load capacity discrimination criterion.

According to this embodiment, when the load capacity discrimination part 100*d* decides that the load capacity of microwaves is equal to or lower than the preset load capacity discrimination criterion, the control unit 2100, 3100 sets the first oscillation mode in which microwaves are periodically generated from the magnetron 11. Thus, in a case where the microwave oven is mounted on an airplane, interference between microwaves and the inboard wireless LAN (Local Area Network) is prevented.

As the load capacity of microwaves increases more and more, unnecessary radiation quantity of the microwaves leaking outside from the microwave oven body decreases more and more. Therefore, when it is decided that the load capacity of microwaves detected by the load capacity discrimination part 100*d* is larger than the load capacity discrimination criterion, the control unit 2100, 3100 sets the second oscillation mode in which microwaves are continuously generated from the magnetron 11. As a result of this, even a heating object of high load capacity that involves high power can be heated without affecting the inboard wireless LAN.

In one embodiment, the microwave oven as defined above further comprises:

a consumption time calculating part 100*e* which calculates consumption time indicative of a degree of consumption due to oscillating operation of the magnetron 11 for each heating operation based on a heating time for heating the heating object as well as on a duty ratio at which microwaves from the magnetron 11 are periodically turned on and off;

a consumption time totalizing part 100*f* which totalizes consumption times of the magnetron 11 calculated by the consumption time calculating part 100*e;* a consumption time discrimination part 100*g* which discriminates whether or not a total value of consumption times of the magnetron 11 obtained by the consumption time totalizing part 100*f* has exceeded a preset consumption time discrimination criterion; and a notification part 7 which notifies a replacement timing of the magnetron 11 when the consumption time discrimination part 100*g* decides that the total value of the consumption times of the magnetron 11 has exceeded the consumption time discrimination criterion.

According to this embodiment, consumption time indicative of the degree of consumption due to oscillating operation of the magnetron 11 is calculated by the consumption time calculating part 100*e* for each heating operation based on the heating time for heating the heating object as well as on the duty ratio at which microwaves from the magnetron 11 are periodically turned on and off. In this connection, the consumption time of the magnetron 11 calculated by the consumption time calculating part 100*e* is not actual time of oscillating operation of the magnetron 11 in the case of periodical oscillation of microwaves, and service life of the magnetron 11 becomes increasingly shorter than that in the case of continuous oscillation with decreasing duty ratio at which microwaves are periodically turned on and off. Therefore, the consumption time calculated by the consumption time calculating part 100*e* becomes longer than the actual time of continuous oscillating operation of the magnetron 11. In such a way, consumption times of the magnetron 11 calculated by the consumption time calculating part 100*e* are totalized by the consumption time totalizing part 100*f*, where when it is decided by the consumption time discrimination part 100*g* that the total value of consumption times of the magnetron 11 has exceeded the preset consumption time discrimination criterion, it is notified by the notification part that it is time to replace the magnetron 11. As a result of this, in heat cooking in which microwaves from the magnetron 11 are periodically turned on and off, the replacement timing of the magnetron 11 can be notified correctly even with heavy use of heat cooking at different duty ratios.

In one embodiment, the microwave oven as defined above further comprises:

a magnetron driving part 4021 which applies high voltage to the magnetron 4011; and a filament driving part 4022 which applies voltage to a filament 4011*a* of the magnetron 4011, wherein the control unit 4100, 5100 controls the magnetron driving part 4021 and the filament driving part 4022 to generate microwaves from the magnetron 4011, and when heating operation in which the heating object is heated with microwaves generated from the magnetron 4011 is resumed upon recovery from instantaneous power failure of power supply input supplied from outside, the control unit 4100, 5100 makes voltage application to the filament 4011*a* started by the filament driving part 4022 before making high voltage applied to the magnetron 4011 by the magnetron driving part 4021.

According to this embodiment, when heating operation is resumed upon recovery from instantaneous power failure of power supply input supplied from outside during heating operation in which the heating object is heated with microwaves generated from the magnetron 4011, the control unit 4100, 5100 makes preheating started by the filament driving part 4022 with voltage application to the filament 4011*a* before high-voltage application to the magnetron 4011 by the magnetron driving part 4021, so that the filament 4011*a* is preheated before the magnetron 4011 is oscillated with the high voltage applied thereto. Thus, the magnetron 4011 is oscillated reliably without incurring its moding state.

In one embodiment, the microwave oven as defined above further comprises an instantaneous-power-failure time measuring part 4024 which measures instantaneous power failure time upon instantaneous power failure of the power supply input, wherein when heating operation in which the heating object is heated with microwaves periodically generated from the magnetron 4011 is resumed upon recovery from instantaneous power failure of the power supply input, and moreover when an instantaneous power failure time measured by the instantaneous-power-failure time measuring part 4024 is equal to or larger than a preset discrimination criterion, the control unit 4100, 5100 makes voltage application to the filament 4011*a* started by the filament driving part 4022 at a time point which is earlier by the post-recovery-from-instantaneous-power-failure preheating time than a time point at which high voltage is applied to the magnetron 4011 by the magnetron driving part 4021.

According to this embodiment, when heating operation in which the heating object is heated with microwaves periodically generated from the magnetron 4011 is resumed upon recovery from instantaneous power failure of power supply input, and moreover when an instantaneous power failure time measured by the instantaneous-power-failure time measuring part 4024 is equal to or larger than a preset discrimination criterion, the control unit 4100, 5100 makes voltage application to the filament 4011*a* started by the filament driving part 4022 at a time point which is earlier by the post-recovery-from-instantaneous-power-failure preheating time than a time point at which high voltage is applied to the magnetron 4011 by the magnetron driving part 4021. As a result of this, with execution of the preheating of the filament 4011*a* by the filament driving part 4022 in cases of such long instantaneous power failure time as causes temperature decrease of the filament 4011*a*, or without execution of the preheating of the filament 4011*a* by the filament driving part 4022 in cases of such short instantaneous power failure time as allows enough preheating of the filament 4011*a* to be ensured, the magnetron 4011 can be oscillated with the high voltage applied thereto. Thus, preheating of the filament 4011*a* is controlled depending on whether the instantaneous power failure time is short or long, so that excess preheating of the filament 4011*a* can be saved.

In one embodiment, in the microwave oven as defined above, the post-recovery-from-instantaneous-power-failure preheating time, which is a time duration from a start of voltage application to the filament 4011*a* until high-voltage application to the magnetron 4011, is determined based on an elapsed time from the start of voltage application to the filament 4011*a* or a temperature of the filament 4011*a*.

According to this embodiment, since the post-recovery-from-instantaneous-power-failure preheating time is determined based on an elapsed time from the start of voltage application to the filament 4011*a* or a temperature of the filament 4011*a*, an optimum preheating time corresponding to a degree of temperature decrease of the filament 4011*a* can be set.

In one embodiment, in the microwave oven as defined above, the post-recovery-from-instantaneous-power-failure preheating time, which is a time duration from a start of voltage application to the filament 4011*a* until high-voltage application to the magnetron 4011, is determined based on the instantaneous power failure time measured by the instantaneous-power-failure time measuring part 4024.

According to this embodiment, since the temperature of the filament 4011*a* decreases more and more with the increasing instantaneous power failure time, an optimum preheating time corresponding to a degree of temperature decrease of the filament 4011*a* can be set by determining the post-recovery-from-instantaneous-power-failure preheating time based on the instantaneous power failure time measured by the instantaneous-power-failure time measuring part 4024.

In one embodiment, the microwave oven as defined above further comprises a magnetron oscillation detection part 4025 which detects oscillation of the magnetron 4011 with high voltage applied thereto by the magnetron driving part 4021, wherein the control unit 5100 performs such control process that voltage is applied to the filament 4011*a* by the filament driving part 4022 over a range stretching before and after a rising point of a microwave generated from the magnetron 4011, and that when the magnetron oscillation detection part 4025 has detected oscillation of the magnetron 4011 after the microwave rises, voltage application to the filament 4011*a* by the filament driving part 4022 is stopped.

According to this embodiment, the preheating time for the filament 4011*a* is ensured before the application of high voltage to the magnetron 4011 by the magnetron driving part 4021, and when the magnetron oscillation detection part 4025 has detected oscillation of the magnetron 4011, the voltage application to the filament 4011*a* is ended. As a result of this, the filament 4011*a* to which the voltage is applied can be prevented from increasing in temperature higher than during preheating by the oscillation of the magnetron 4011, so that a temperature difference between the temperature of the filament 4011*a* in the preheating state and the temperature of the filament 4011*a* in the oscillation state of the magnetron 4011 can be lessened. By thus lessening temperature variations of the filament 4011*a* of the magnetron 4011, the service life of the magnetron 4011 can be prolonged.

In one embodiment, the microwave oven as defined above further comprises:

a cooling fan 4015 which cools the magnetron 4011 while the heating object is being heated with microwaves generated from the magnetron 4011; and a power interrupting part 4023 which interrupts the power supply input supplied from outside, wherein the control unit 4100, 5100 drives the cooling fan 4015 during heating operation in which the heating object is heated with microwaves generated from the magnetron 4011, where when the power supply input is to be interrupted by the power interrupting part 4023 after an end of the heating operation, voltage application to the filament 4011*a* by the filament driving part 4022 is stopped after elapse of a preset first stop time from a time point of the end of the heating operation at which the high-voltage application to the magnetron 4011 is stopped, and then, after elapse of a preset second stop time from a time point at which the voltage application to the filament 4011*a* is stopped, the cooling fan 4015 is stopped and the power supply input is interrupted by the power interrupting part 4023.

For example, in the case where the power supply input is automatically interrupted to reduce standby-state power consumption after an end of the heating operation, if the voltage application to the filament 4011*a* and the cooling fan 4015 are simultaneously stopped, the temperature of the filament 4011*a* increases to an overshooting extent, causing the magnetron 4011 to be shortened in service life due to temperature variations of the filament 4011*a*. Therefore, according to this embodiment, when the power supply input is to be interrupted by the power interrupting part 4023, high-voltage application to the magnetron 4011 is first stopped and then, after elapse of the first stop time, voltage application to the filament 4011*a* by the filament driving part 4022 is stopped, and then, after elapse of the second stop time, the cooling fan 4015 is stopped and the power supply input is interrupted by the power interrupting part 4023. Thus, temperature increases of the filament 4011*a* to an overshooting extent are prevented from occurring upon interruption of the power supply input by the power interrupting part 4023, so that the service life of the magnetron 4011 can be prolonged.

A microwave oven according to another aspect of the invention comprises:

a magnetron 11 which generates microwaves by power supply voltage supplied from outside;

a frequency detection part 23 which detects a frequency of the power supply voltage;

a frequency discrimination part 100*b* which discriminates whether or not the frequency of the power supply voltage detected by the frequency detection part 23 is within a preset frequency range; and a control unit 100, 1100, 2100, 3100 which controls the magnetron 11 based on a result of the discrimination by the frequency discrimination part 100*b*, wherein during heating operation in which the heating object is heated with microwaves generated from the magnetron 11, the control unit 100, 1100, 2100, 3100 stops oscillation of the magnetron 11 when the frequency discrimination part 100*b* decides that the frequency of the power supply voltage is not within the preset frequency range.

According to this arrangement, during heating operation in which a heating object is heated with microwaves generated from the magnetron 11, when the frequency discrimination part 100*b* has decided that the frequency of the power supply voltage is not within the preset frequency range, the oscillation of the magnetron 11 is stopped by the control unit 100, 1100, 2100, 3100. Therefore, even the frequency of the power supply voltage has largely varied during the heating operation with microwaves, abnormal operation of the magnetron 11 can be prevented. It is also possible to oscillate the magnetron 11 normally again when the frequency discrimination part 100*b* decides that the frequency of the power supply voltage has become within the preset frequency range after the oscillation stop of the magnetron 11.

In one embodiment, in the microwave oven as defined above, when the frequency discrimination part 100*b* decides that the frequency of the power supply voltage has become within the frequency range after an oscillation stop of the magnetron 11 during the heating operation, the control unit 100, 1100, 2100, 3100 makes the magnetron 11 oscillated to resume the heating operation.

According to this embodiment, when the frequency discrimination part 100*b* decides that the frequency of the power supply voltage has become within the frequency range after an oscillation stop of the magnetron 11 in the heating operation, the control unit 100, 1100, 2100, 3100 makes the magnetron 11 oscillated to resume the heating operation. Therefore, even if the frequency of the power supply voltage varies so largely that the magnetron 11 is temporarily stopped, the heat cooking can be completed.

In one embodiment, the microwave oven as defined above further comprises:

an oscillation-stop time measuring part 24 which measures an oscillation stop time of the magnetron 11 in the heating operation; and a heating time correcting part 100*c* which, after an oscillation stop of the magnetron 11 in the heating operation, corrects remaining heating time of the heating operation based on the oscillation stop time of the magnetron 11 measured by the oscillation-stop time measuring part 24 when the heating operation is resumed upon a decision by the frequency discrimination part 100*b* that the frequency of the power supply voltage has become within the frequency range.

According to this embodiment, after an oscillation stop of the magnetron 11 in heating operation, when the heating operation is resumed upon a decision by the frequency discrimination part 100*b* that a frequency of the power supply voltage has become within the frequency range, the remaining heating time of the heating operation is corrected by the heating time correcting part 100*c* based on the oscillation stop time of the magnetron 11 measured by the oscillation-stop time measuring part 24. Therefore, even if the oscillation of microwaves is stopped during heating operation, the remaining heating is carried out with the heating time corrected in correspondence to the oscillation stop time. Thus, for example, since the heating object is cooled more and more with increasing oscillation stop time, prolonging the remaining heating time makes it possible to complete the heating operation without deteriorating the heating quality.

In one embodiment, the microwave oven as defined above further comprises a load capacity discrimination part 100*d* which discriminates as to a load capacity of the microwaves, wherein the control unit 2100, 3100 sets a first oscillation mode in which microwaves are periodically generated from the magnetron 11 when the load capacity discrimination part 100*d* decides that the load capacity of the microwaves is equal to or lower than a preset load capacity discrimination criterion, and sets a second oscillation mode which microwaves are continuously generated from the magnetron 11 when the load capacity discrimination part 100*d* decides that a load capacity of the microwaves detected by the load capacity discrimination part 100*d* is larger than the load capacity discrimination criterion.

According to this embodiment, when the load capacity discrimination part 100*d* decides that the load capacity of microwaves is equal to or lower than the preset load capacity discrimination criterion, the control unit 2100, 3100 sets the first oscillation mode in which microwaves are periodically generated from the magnetron 11. Thus, in a case where the microwave oven is mounted on an airplane, interference between microwaves and the inboard wireless LAN (Local Area Network) is prevented.

As the load capacity of microwaves increases more and more, unnecessary radiation quantity of the microwaves leaking outside from the microwave oven body decreases more and more. Therefore, when it is decided that the load capacity of microwaves detected by the load capacity discrimination part 100*d* is larger than the load capacity discrimination criterion, the control unit 2100, 3100 sets the second oscillation mode in which microwaves are continuously generated from the magnetron 11. As a result of this, even a heating object of high load capacity that involves high power can be heated without affecting the inboard wireless LAN.

In one embodiment, the microwave oven as defined above further comprises:

a consumption time calculating part 100*e* which calculates consumption time indicative of a degree of consumption due to oscillating operation of the magnetron 11 for each heating operation based on a heating time for heating the heating object as well as on a duty ratio at which microwaves from the magnetron 11 are periodically turned on and off;

a consumption time totalizing part 100*f* which totalizes consumption times of the magnetron 11 calculated by the consumption time calculating part 100*e;* a consumption time discrimination part 100*g* which discriminates whether or not a total value of consumption times of the magnetron 11 obtained by the consumption time totalizing part 100*f* has exceeded a preset consumption time discrimination criterion; and a notification part 7 which notifies a replacement timing of the magnetron 11 when the consumption time discrimination part 1008 decides that the total value of the consumption times of the magnetron 11 has exceeded the consumption time discrimination criterion.

According to this embodiment, consumption time indicative of the degree of consumption due to oscillating operation of the magnetron 11 is calculated by the consumption time calculating part 100*e* for each heating operation based on the heating time for heating the heating object as well as on the duty ratio at which microwaves from the magnetron 11 are periodically turned on and off. In this connection, the consumption time of the magnetron 11 calculated by the consumption time calculating part 100*e* is not actual time of oscillating operation of the magnetron 11 in the case of periodical oscillation of microwaves, and service life of the magnetron 11 becomes increasingly shorter than that in the case of continuous oscillation with decreasing duty ratio at which microwaves are periodically turned on and off. Therefore, the consumption time calculated by the consumption time calculating part 100*e* becomes longer than the actual time of continuous oscillating operation of the magnetron 11. In such a way, consumption times of the magnetron 11 calculated by the consumption time calculating part 100*e* are totalized by the consumption time totalizing part 100*f*, where when it is decided by the consumption time discrimination part 100*g* that the total value of consumption times of the magnetron 11 has exceeded the preset consumption time discrimination criterion, it is notified by the notification part that it is time to replace the magnetron 11. As a result of this, in heat cooking in which microwaves from the magnetron 11 are periodically turned on and off, the replacement timing of the magnetron 11 can be notified correctly even with heavy use of heat cooking at different duty ratios.

A microwave oven according to another aspect of the invention comprises:

a magnetron 4011 which generates microwaves to heat a heating object;

a magnetron driving part 4021 which applies high voltage to the magnetron 4011;

a filament driving part 4022 which applies voltage to a filament 4011*a* of the magnetron 4011; and a control unit 4100, 5100 which controls the magnetron driving part 4021 and the filament driving part 4022 to generate microwaves from the magnetron 4011, wherein when heating operation in which the heating object is heated with microwaves generated from the magnetron 4011 is resumed upon recovery from instantaneous power failure of power supply input supplied from outside, the control unit 4100, 5100 makes voltage application to the filament 4011*a* started by the filament driving part 4022 before making high voltage applied to the magnetron 4011 by the magnetron driving part 4021.

According to this arrangement, when heating operation is resumed upon recovery from instantaneous power failure of power supply input supplied from outside during heating operation in which the heating object is heated with microwaves generated from the magnetron 4011, the control unit 4100, 5100 makes preheating started by the filament driving part 4022 with voltage application to the filament 4011*a* before high-voltage application to the magnetron 4011 by the magnetron driving part 4021, so that the filament 4011*a* is preheated before the magnetron 4011 is oscillated with the high voltage applied thereto. Thus, the magnetron 4011 can be oscillated reliably without incurring its moding state.

In one embodiment, the microwave oven as defined above further comprises an instantaneous-power-failure time measuring part 4024 which measures instantaneous power failure time upon instantaneous power failure of the power supply input, wherein when heating operation in which the heating object is heated with microwaves periodically generated from the magnetron 4011 is resumed upon recovery from instantaneous power failure of the power supply input, and moreover when an instantaneous power failure time measured by the instantaneous-power-failure time measuring part 4024 is equal to or larger than a preset discrimination criterion, the control unit 4100, 5100 makes voltage application to the filament 4011*a* started by the filament driving part 4022 at a time point which is earlier by the post-recovery-from-instantaneous-power-failure preheating time than a time point at which high voltage is applied to the magnetron 4011 by the magnetron driving part 4021.

According to this embodiment, when heating operation in which the heating object is heated with microwaves periodically generated from the magnetron 4011 is resumed upon recovery from instantaneous power failure of power supply input, and moreover when an instantaneous power failure time measured by the instantaneous-power-failure time measuring part 4024 is equal to or larger than a preset discrimination criterion, the control unit 4100, 5100 makes voltage application to the filament 4011*a* started by the filament driving part 4022 at a time point which is earlier by the post-recovery-from-instantaneous-power-failure preheating time than a time point at which high voltage is applied to the magnetron 4011 by the magnetron driving part 4021. As a result of this, with execution of the preheating of the filament 4011*a* by the filament driving part 4022 in cases of such long instantaneous power failure time as causes temperature decrease of the filament 4011*a*, or without execution of the preheating of the filament 4011*a* by the filament driving part 4022 in cases of such short instantaneous power failure time as allows enough preheating of the filament 4011*a* to be ensured, the magnetron 4011 can be oscillated with the high voltage applied thereto. Thus, preheating of the filament 4011*a* is controlled depending on whether the instantaneous power failure time is short or long, so that excess preheating of the filament 4011*a* can be saved.

In one embodiment, in the microwave oven as defined above, the post-recovery-from-instantaneous-power-failure preheating time, which is a time duration from a start of voltage application to the filament 4011*a* until high-voltage application to the magnetron 4011, is determined based on an elapsed time from the start of voltage application to the filament 4011*a* or a temperature of the filament 4011*a*.

According to this embodiment, since the post-recovery-from-instantaneous-power-failure preheating time is determined based on an elapsed time from the start of voltage application to the filament 4011*a* or a temperature of the filament 4011*a*, an optimum preheating time corresponding to a degree of temperature decrease of the filament 4011*a* can be set.

In one embodiment, in the microwave oven as defined above, the post-recovery-from-instantaneous-power-failure preheating time, which is a time duration from a start of voltage application to the filament 4011*a* until high-voltage application to the magnetron 4011, is determined based on the instantaneous power failure time measured by the instantaneous-power-failure time measuring part 4024.

According to this embodiment, since the temperature of the filament 4011*a* decreases more and more with the increasing instantaneous power failure time, an optimum preheating time corresponding to a degree of temperature decrease of the filament 4011*a* can be set by determining the post-recovery-from-instantaneous-power-failure preheating time based on the instantaneous power failure time measured by the instantaneous-power-failure time measuring part 4024.

In one embodiment, the microwave oven as defined above further comprises a magnetron oscillation detection part 4025 which detects oscillation of the magnetron 4011 with high voltage applied thereto by the magnetron driving part 4021, wherein the control unit 5100 performs such control process that voltage is applied to the filament 4011*a* by the filament driving part 4022 over a range stretching before and after a rising point of a microwave generated from the magnetron 4011, and that when the magnetron oscillation detection part 4025 has detected oscillation of the magnetron 4011 after the microwave rises, voltage application to the filament 4011*a* by the filament driving part 4022 is stopped.

According to this embodiment, the preheating time for the filament 4011*a* is ensured before the application of high voltage to the magnetron 4411 by the magnetron driving part 4021, and when the magnetron oscillation detection part 4025 has detected oscillation of the magnetron 4011, the voltage application to the filament 4011*a* is ended. As a result of this, the filament 4011*a* to which the voltage is applied can be prevented from increasing in temperature higher than during preheating by the oscillation of the magnetron 4011, so that a temperature difference between the temperature of the filament 4011*a* in the preheating state and the temperature of the filament 4011*a* in the oscillation state of the magnetron 4011 can be lessened. By thus lessening temperature variations of the filament 4011*a* of the magnetron 4011, the service life of the magnetron 4011 can be prolonged.

In one embodiment, the microwave oven as defined above further comprises:

a cooling fan 4015 which cools the magnetron 4011 while the heating object is being heated with microwaves generated from the magnetron 4011; and a power interrupting part 4023 which interrupts the power supply input supplied from outside, wherein the control unit 4100, 5100 drives the cooling fan 4015 during heating operation in which the heating object is heated with microwaves generated from the magnetron 4011, where when the power supply input is to be interrupted by the power interrupting part 4023 after an end of the heating operation, voltage application to the filament 4011*a* by the filament driving part 4022 is stopped after elapse of a preset first stop time from a time point of the end of the heating operation at which the high-voltage application to the magnetron 4011 is stopped, and then, after elapse of a preset second stop time from a time point at which the voltage application to the filament 4011*a* is stopped, the cooling fan 4015 is stopped and the power supply input is interrupted by the power interrupting part 4023.

For example, in the case where the power supply input is automatically interrupted to reduce standby-state power consumption after an end of the heating operation, if the voltage application to the filament 4011*a* and the cooling fan 4015 are simultaneously stopped, the temperature of the filament 4011*a* increases to an overshooting extent, causing the magnetron 4011 to be shortened in service life due to temperature variations of the filament 4011*a*. Therefore, according to this embodiment, when the power supply input is to be interrupted by the power interrupting part 4023, high-voltage application to the magnetron 4011 is first stopped and then, after elapse of the first stop time, voltage application to the filament 4011*a* by the filament driving part 4022 is stopped, and then, after elapse of the second stop time, the cooling fan 4015 is stopped and the power supply input is interrupted by the power interrupting part 4023. Thus, temperature increases of the filament 4011*a* to an overshooting extent are prevented from occurring upon interruption of the power supply input by the power interrupting part 4023, so that the service life of the magnetron 4011 can be prolonged.

REFERENCE SIGNS LIST

1 microwave oven
2 cabinet
3 operation section
4 door
5 handle
6 window made from heat-resistant glass
7 LCD part
10 heating chamber
11 magnetron
11*a* filament
12 waveguide
13 rotating-antenna motor
14 rotating antenna
15 cooling fan
16 outside-air inflow duct
17 outside-air inflow port
20 door opening/closing detection switch

21 magnetron-use high-voltage transformer
22 magnetron-use heater transformer
23 frequency detection part
24 oscillation-stop time measuring part
27 refuse receiver
30 bottom tray
100, 1100, 2100, 3100 control unit
100*a* timer
100*b* frequency discrimination part
100*c* heating time correcting part
100*d* load capacity discrimination part
100*e* consumption time calculating part
100*f* consumption time totalizing part
100*g* consumption time discrimination part
4001 microwave oven
4002 cabinet
4003 operation section
4004 door
4005 handle
4006 window made from heat-resistant glass
4007 LCD part
4010, 4110 heating chamber
4011 magnetron
4011*a* filament
4012 waveguide
4013 rotating-antenna motor
4014 rotating antenna
4015 cooling fan
4016 outside-air inflow duct
4017 outside-air inflow port
4020 door opening/closing detection switch
4021 magnetron-use high-voltage transformer
4022 magnetron-use heater transformer
4023 power interrupting part
4024 instantaneous-power-failure time measuring part
4025 magnetron oscillation detection part
4027 refuse receiver
4030, 4130, 4230 bottom tray
4100, 5100 control unit
4100*a* CPU
4100*b* memory
4100*c* timer

What is claimed is:

1. A microwave oven to be mounted on an airplane and supplied with power supply voltage having a variable frequency, comprising:

a magnetron which generates microwaves by the power supply voltage supplied from the airplane;

a frequency detection part which detects a frequency of the power supply voltage;

a frequency discrimination part which discriminates whether or not the frequency of the power supply voltage detected by the frequency detection part is within a preset frequency range, wherein the preset frequency range has an upper limit and a lower unit, upper limit being different from the lower limit; and a control unit which controls the magnetron based on a result of the discrimination by the frequency discrimination part, wherein during heating operation in which a heating object is heated with microwaves generated from the magnetron, the control unit stops oscillation of the magnetron when the frequency discrimination part decides that the frequency of the power supply voltage is not within the preset frequency range by being lower than the lower limit or higher than the upper limit of the preset frequency range.

2. The microwave oven as defined in claim 1, wherein when the frequency discrimination part decides that the frequency of the power supply voltage has become within the frequency range after an oscillation stop of the magnetron during the heating operation, the control unit makes the magnetron oscillated to resume the heating operation.

3. The microwave oven as defined in claim 2, further comprising:

an oscillation-stop time measuring part which measures an oscillation stop time of the magnetron in the heating operation; and a heating time correcting part which, after an oscillation stop of the magnetron in the heating operation, corrects remaining heating time of the heating operation based on the oscillation stop time of the magnetron measured by the oscillation-stop time measuring part when the heating operation is resumed upon a decision by the frequency discrimination part that the frequency of the power supply voltage has become within the frequency range.

4. The microwave oven as defined in claim 1, further comprising:

a load capacity discrimination part which discriminates as to a load capacity of the microwaves, wherein the control unit sets a first oscillation mode in which microwaves are periodically generated from the magnetron when the load capacity discrimination part decides that the load capacity of the microwaves is equal to or lower than a preset load capacity discrimination criterion, and sets a second oscillation mode in which microwaves are continuously generated from the magnetron when the load capacity discrimination part decides that a load capacity of the microwaves detected by the load capacity discrimination part is larger than the load capacity discrimination criterion.

5. The microwave oven as defined in claim 1, further comprising:

a consumption time calculating part which calculates consumption time indicative of a degree of consumption due to oscillating operation of the magnetron for each heating operation based on a heating time for heating the heating object as well as on a duty ratio at which microwaves from the magnetron are periodically turned on and off;

a consumption time totalizing part which totalizes consumption times of the magnetron calculated by the consumption time calculating part;

a consumption time discrimination part which discriminates whether or not a total value of consumption times of the magnetron obtained by the consumption time totalizing part has exceeded a preset consumption time discrimination criterion; and a notification part which notifies a replacement timing of the magnetron when the consumption time discrimination part decides that the total value of the consumption times of the magnetron has exceeded the consumption time discrimination criterion.

6. The microwave oven as defined in claim 1, further comprising:

a load capacity discrimination part which discriminates as to a load capacity of the microwaves, wherein the control unit sets a first oscillation mode in which microwaves are periodically generated from the magnetron when the load capacity discrimination part decides that the load capacity of the microwaves is equal to or lower than a preset load capacity discrimination criterion, and sets a second oscillation mode in which microwaves are continuously generated from the magnetron when the load capacity discrimination part decides that a load capacity of the microwaves detected by the load capacity discrimination part is larger than the load capacity discrimination criterion.

7. The microwave oven as defined in claim 1, further comprising:

a consumption time calculating part which calculates consumption time indicative of a degree of consumption due to oscillating operation of the magnetron for each heating operation based on a heating time for heating the heating object as well as on a duty ratio at which microwaves from the magnetron are periodically turned on and off;

a consumption time totalizing part which totalizes consumption times of the magnetron calculated by the consumption time calculating part;

a consumption time discrimination part which discriminates whether or not a total value of consumption times of the magnetron obtained by the consumption time totalizing part has exceeded a preset consumption time discrimination criterion; and a notification part which notifies a replacement timing of the magnetron when the consumption time discrimination part decides that the total value of the consumption times of the magnetron has exceeded the consumption time discrimination criterion.

8. A microwave oven, comprising:

a magnetron which generates microwaves to heat a heating object;

a magnetron driving part which applies high voltage to the magnetron;

a filament driving part which applies voltage to a filament of the magnetron; and a control unit which controls the magnetron, wherein the control unit controls the magnetron driving part and the filament driving part to generate microwaves from the magnetron, and when heating operation in which the heating object is heated with microwaves generated from the magnetron is resumed upon recovery from instantaneous power failure of power supply input supplied from outside, the control unit makes voltage application to the filament started by the filament driving part before making high voltage applied to the magnetron by the magnetron driving part, the microwave oven further comprising:

a cooling fan which cools the magnetron while the heating object is being heated with microwaves generated from the magnetron; and a power interrupting part which interrupts the power supply input supplied from outside, wherein the control unit drives the cooling fan during heating operation in which the heating object is heated with microwaves generated from the magnetron, where when the power supply input is interrupted by the power interrupting part after an end of the heating operation, voltage application to the filament by the filament driving part is stopped after elapse of a preset first stop time from a time point of the end of the heating operation at which the high-voltage application to the magnetron is stopped, and then, after elapse of a preset second stop time from a time point at which the voltage application to the filament is stopped, the cooling fan is stopped and the power supply input is interrupted by the power interrupting part.

9. The microwave oven as defined in claim 8, further comprising:

an instantaneous-power-failure time measuring part which measures instantaneous power failure time upon instantaneous power failure of the power supply input, wherein when heating operation in which the heating object is heated with microwaves periodically generated from the magnetron is resumed upon recovery from instantaneous power failure of the power supply input, and moreover when an instantaneous power failure time measured by the instantaneous-power-failure time measuring part is equal to or larger than a preset discrimination criterion, the control unit makes voltage application to the filament started by the filament driving part at a time point which is earlier than a time point at which high voltage is applied to the magnetron by the magnetron driving part.

10. The microwave oven as defined in claim 9, wherein a post-recovery-from-instantaneous-power-failure preheating time, which is a time duration from a start of voltage application to the filament until high-voltage application to the magnetron, is determined based on the instantaneous power failure time measured by the instantaneous-power-failure time measuring part.

11. The microwave oven as defined in claim 9, wherein a post-recovery-from-instantaneous-power-failure preheating time, which is a time duration from a start of voltage application to the filament until high-voltage application to the magnetron, is determined based on an elapsed time from the start of voltage application to the filament or a temperature of the filament.

12. The microwave oven as defined in claim 8, wherein a post-recovery-from-instantaneous-power-failure preheating time, which is a time duration from a start of voltage application to the filament until high-voltage application to the magnetron, is determined based on an elapsed time from the start of voltage application to the filament or a temperature of the filament.

13. A microwave oven, comprising:

a magnetron which generates microwaves to heat a heating object;

a magnetron driving part which applies high voltage to the magnetron;

a filament driving part which applies voltage to a filament of the magnetron; and a control unit which controls the magnetron, wherein the control unit controls the magnetron driving part and the filament driving part to generate microwaves from the magnetron, and when heating operation in which the heating object is heated with microwaves generated from the magnetron is resumed upon recovery from instantaneous power failure of power supply input supplied from outside, the control unit makes voltage application to the filament started by the filament driving part before making high voltage applied to the magnetron by the magnetron driving part, the microwave oven further comprising a magnetron oscillation detection part which detects oscillation of the magnetron with high voltage applied thereto by the magnetron driving part, wherein the control unit performs such control process that voltage is applied to the filament by the filament driving part over a range stretching before and after a rising point of a microwave generated from the magnetron, and that when the magnetron oscillation detection part has detected oscillation of the magnetron after the microwave rises, voltage application to the filament by the filament driving part is stopped.

14. The microwave oven as defined in claim 13, further comprising:

an instantaneous-power-failure time measuring part which measures instantaneous power failure time upon instantaneous power failure of the power supply input, wherein when heating operation in which the heating object is heated with microwaves periodically generated from the magnetron is resumed upon recovery from instantaneous power failure of the power supply input, and moreover when an instantaneous power failure time measured by the instantaneous-power-failure time measuring part is equal to or larger than a preset discrimination criterion, the control unit makes voltage application to the filament started by the filament driving part at a time point which is earlier than a time point at which high voltage is applied to the magnetron by the magnetron driving part.

15. The microwave oven as defined in claim 13, wherein a post-recovery-from-instantaneous-power-failure preheating time, which is a time duration from a start of voltage application to the filament until high-voltage application to the magnetron, is determined based on an elapsed time from the start of voltage application to the filament or a temperature of the filament.

16. The microwave oven as defined in claim 15, wherein a post-recovery-from-instantaneous-power-failure preheating time, which is a time duration from a start of voltage application to the filament until high-voltage application to the magnetron, is determined based on the instantaneous power failure time measured by the instantaneous-power-failure time measuring part.

* * * * *